US011655681B2

(12) United States Patent
Atkins

(10) Patent No.: US 11,655,681 B2
(45) Date of Patent: May 23, 2023

(54) INNER CUTTER FOR DRILLING

(71) Applicant: Halliburton Energy Serivces, Inc., Houston, TX (US)

(72) Inventor: William Brian Atkins, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 8 days.

(21) Appl. No.: 17/286,368

(22) PCT Filed: Sep. 16, 2019

(86) PCT No.: PCT/US2019/051340

§ 371 (c)(1),
(2) Date: Apr. 16, 2021

(87) PCT Pub. No.: WO2020/117350

PCT Pub. Date: Jun. 11, 2020

(65) Prior Publication Data

US 2021/0381317 A1 Dec. 9, 2021

Related U.S. Application Data

(60) Provisional application No. 62/776,021, filed on Dec. 6, 2018.

(51) Int. Cl.

| | |
|---|---|
| ***E21B 10/55*** | (2006.01) |
| ***E21B 10/567*** | (2006.01) |
| ***E21B 10/43*** | (2006.01) |

(52) U.S. Cl.

CPC ..... *E21B 10/5673* (2013.01); *E21B 10/43* (2013.01); *E21B 10/55* (2013.01)

(58) Field of Classification Search

CPC ..... E21B 10/43; E21B 10/55; E21B 10/5673
See application file for complete search history.

(56) References Cited

U.S. PATENT DOCUMENTS

| | | | |
|---|---|---|---|
| D357,485 | S | 4/1995 | Mattsson et al. |
| D357,486 | S | 4/1995 | Mattsson et al. |
| D371,146 | S | 6/1996 | Fischer et al. |
| D371,374 | S | 7/1996 | Fischer et al. |
| 5,709,279 | A | 1/1998 | Dennis |

(Continued)

FOREIGN PATENT DOCUMENTS

| | | | |
|---|---|---|---|
| CA | 2839696 | A1 | 12/2012 |
| GB | 2274129 | A | 7/1994 |

(Continued)

OTHER PUBLICATIONS

CN Application No. 201980002131.4, Office Action, dated Jul. 5, 2021, 15 pages, including English translation.

(Continued)

*Primary Examiner* — Daniel P Stephenson
(74) *Attorney, Agent, or Firm* — Delizio, Peacock, Lewin & Guerra

(57) ABSTRACT

A drill bit includes a bit body defining a bit rotational axis and a blade attached to the bit body. The apparatus also includes a cutter comprising a cutting arc on a cutting surface of the cutter, wherein the cutter comprises at least one relief comprising a straight edge and a curved edge having an end that interrupts the cutting arc.

17 Claims, 15 Drawing Sheets

(56) References Cited

U.S. PATENT DOCUMENTS

| | | | | |
|---|---|---|---|---|
| 5,740,874 | A | 4/1998 | Matthias | |
| 6,045,440 | A | 4/2000 | Johnson et al. | |
| D424,579 | S | 5/2000 | Brady | |
| 6,065,554 | A * | 5/2000 | Taylor | E21B 10/5735 175/430 |
| 6,196,340 | B1 | 3/2001 | Jensen et al. | |
| D477,005 | S | 7/2003 | Arvidsson | |
| 6,904,984 | B1 | 6/2005 | Estes et al. | |
| D554,162 | S | 10/2007 | Hall et al. | |
| D606,569 | S | 12/2009 | Ford et al. | |
| 8,037,951 | B2 | 10/2011 | Shen et al. | |
| 8,061,456 | B2 | 11/2011 | Patel et al. | |
| 8,096,372 | B2 | 1/2012 | Shen et al. | |
| D656,166 | S | 3/2012 | Michelet et al. | |
| D656,973 | S | 4/2012 | Michelet et al. | |
| 8,186,460 | B2 | 5/2012 | Garcia et al. | |
| D682,898 | S | 5/2013 | Fujii | |
| 8,783,387 | B2 | 7/2014 | Durairajan et al. | |
| D738,412 | S | 9/2015 | Choi et al. | |
| D753,748 | S | 4/2016 | Schneider et al. | |
| 9,309,724 | B2 | 4/2016 | Scott et al. | |
| 9,347,275 | B2 | 5/2016 | Azar et al. | |
| 9,415,447 | B2 | 8/2016 | Myers | |
| 9,889,502 | B2 | 2/2018 | Ownby et al. | |
| D823,909 | S | 7/2018 | Kawakami et al. | |
| D828,415 | S | 9/2018 | Ota et al. | |
| D828,416 | S | 9/2018 | Ota et al. | |
| D845,361 | S | 4/2019 | Komiyama et al. | |
| D852,245 | S | 6/2019 | Kobayashi et al. | |
| D854,063 | S | 7/2019 | Abe et al. | |
| D862,537 | S | 10/2019 | Larose | |
| D875,147 | S | 2/2020 | Xu et al. | |
| D878,436 | S | 3/2020 | Dunaway et al. | |
| D879,168 | S | 3/2020 | Zhao et al. | |
| D880,547 | S | 4/2020 | Weinbert | |
| D884,039 | S | 5/2020 | Endoh et al. | |
| D884,040 | S | 5/2020 | Endoh | |
| D884,041 | S | 5/2020 | Endoh et al. | |
| D911,399 | S * | 2/2021 | Atkins | D15/139 |
| D951,313 | S * | 5/2022 | Keller | D15/139 |
| 2008/0053710 | A1 | 3/2008 | Moss | |
| 2010/0059287 | A1 | 3/2010 | Durairajan et al. | |
| 2013/0020134 | A1 | 1/2013 | Azar et al. | |
| 2013/0112485 | A1 | 5/2013 | Richert | |
| 2013/0313403 | A1 | 11/2013 | Atkins et al. | |
| 2013/0316149 | A1 | 11/2013 | Atkins et al. | |
| 2013/0320598 | A1 | 12/2013 | Atkins et al. | |
| 2013/0333950 | A1 | 12/2013 | Atkins et al. | |
| 2014/0332271 | A1 | 11/2014 | Do et al. | |
| 2015/0308197 | A1 | 10/2015 | Scott et al. | |
| 2016/0076308 | A1 | 3/2016 | Anderle et al. | |
| 2016/0177629 | A1 | 6/2016 | Azar | |
| 2016/0339515 | A1 | 11/2016 | Atkins et al. | |
| 2017/0107768 | A1 | 4/2017 | Saini et al. | |
| 2018/0010396 | A1 | 1/2018 | Dunbar et al. | |
| 2020/0149352 | A1 | 5/2020 | Silveus, III et al. | |
| 2021/0381317 | A1* | 12/2021 | Atkins | E21B 10/5673 |

FOREIGN PATENT DOCUMENTS

| | | | |
|---|---|---|---|
| GB | 2438855 | A | 12/2007 |
| GB | 2453472 | B | 5/2011 |
| WO | 2013130819 | A1 | 9/2013 |

OTHER PUBLICATIONS

GB Application Serial No. GB1915327.9, Combined Search and Examination Report, dated Jun. 24, 2020, 8 pages.

PCT Application Serial No. PCT/US2019/051340, International Search Report, dated Jan. 7, 2020, 4 pages.

PCT Application Serial No. PCT/US2019/051340, International Written Opinion, dated Jan. 7, 2020, 6 pages.

U.S. Appl. No. 29/672,512, Notice of Allowance, dated Nov. 24, 2020, 8 pages.

* cited by examiner

INNER CUTTER FOR DRILLING

PRIORITY CLAIM

This application claims the benefit of priority to U.S. Provisional Patent Application Ser. No. 62/776,021, filed Dec. 6, 2018, which is hereby incorporated by reference in its entirety.

BACKGROUND

The disclosure generally relates to the field of drilling components, and more particularly to drill bit components.

Wellbores are frequently formed in geological formations using rotary drill bits. Various types of rotary drill bits are known in the art, whereby the wellbore is drilled by powered rotation of the drill bit against a formation under an axial load. A fixed cutter drill bit, for example, includes a circumferentially spaced structures known as blades. A plurality of cutters mounted at different fixed positions on the blades are responsible for cutting through the rock by mechanically destroying and removing rock in the drill bit path. The cutter(s) with the shortest radius from the drill bit's axis of rotation is/are commonly referred to as the innermost or center cutters. Each of the cutters can include a substrate, such as carbide, and a superhard, wear-resistant cutting material, such as a polycrystalline diamond compact (PDC) material mounted on the substrate.

BRIEF DESCRIPTION OF THE DRAWINGS

Aspects of the disclosure can be better understood by referencing the accompanying drawings.

DESCRIPTION OF EMBODIMENTS

Figure 1A:
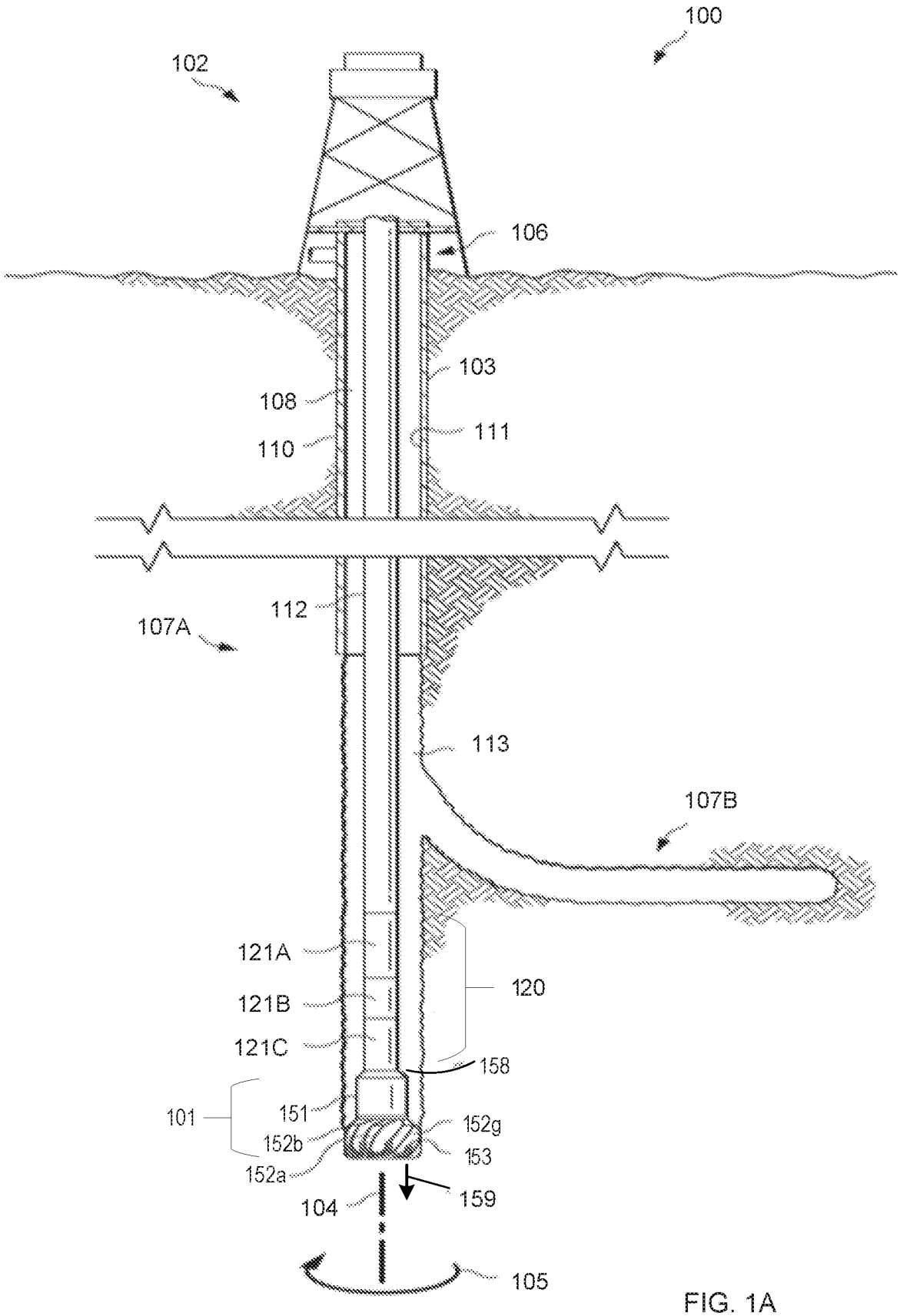
FIG. 1A is an elevation view of a drilling system with a drill bit with cutters.

The description that follows includes example systems, methods, techniques, and program flows that describe various embodiments of the disclosure. However, it is understood that these embodiments can be practiced without these specific details. For instance, this disclosure refers to cutters having one, two, or three reliefs in illustrative examples. Embodiments of this disclosure can be also applied to cutters having any other number of reliefs. In other instances, well-known instruction instances, protocols, structures and techniques have not been shown in detail in order not to obfuscate the description.

Embodiments of drill bits as described in this disclosure include drill bits configured to perform drilling operations in geological formations to create a borehole, for example in an oil or gas well environment. Embodiments of the drill bits are configured to generate and allow the recovery of micro cores as part of the drilling operation. A micro core may comprise a solid piece of the foundation material thru which any of the embodiments of a drill bit as described herein may be operating to drill through. A micro core may be a generally cylindrical shaped piece of the foundation material having a diameter in cross-section that is less than a diameter in cross-section of the borehole being created by the drill bit. In various examples, a micro core includes a piece of foundation material having a diameter in a range of 10 to 40 millimeters (mm) in cross-section. In various embodiments, a micro core has a length dimension along a longitudinal axis of the cylindrical shaped micro core that is at least two time the diameter in cross-section of the same micro core. As further described below, embodiments of the drill bit configured to generate micro cores as part of the drilling process include a recessed center area at the bottom portion or area of the drill bit, the bottom portion or area of the drill bit configured to contact and drill away the terminus portion of a borehole being formed by the drill bit. The recessed center area is at least partially enclosed by the one or more innermost cutters of the drill bit, wherein the inner most cutters is configured to generate a micro core within the recessed center area as the drill bit proceeds into the formation material being drilled by the drilling process. The one or more inner most cutters may further be configured to fracture the micro core from the remainder of the foundation material once the micro core is formed as part of the drilling operation. Embodiments of the drill bit may further include an escapeway that allows the micro cores, once fractured from the foundation material, to be conveyed toward the top surface of the borehole being formed by the drilling operation, for example in a flow of drilling fluid being circulated to and/or thru the drill bit.

In various embodiments of the drill bits described herein, the innermost cutter can include a relief on the cutting material of the cutting surface, wherein at least one end of the relief is located at and interrupts a cutting arc. The relief can be formed in various indented shapes, such as a linear indentation, a curved groove, etc. The relief can include various specific shapes. For example, the relief can include a first curved edge, followed by a straight edge, followed by a second curved edge, wherein a curved edge can be any edge wherein two sides of the cutting surface material are at an angle less than zero. In some embodiments, the first curved edge and the second curved edge can cooperate to increase the edge toughness of the cutting surface. In some embodiments, drilling using a straight edge of the relief results in the generation of a micro core using the drill bit. The second curved edge can operate to fracture the micro core under the side load of the drill bit. Additionally, in some embodiments, the cutting arc of engagement between an innermost cutter of the drill bit and a formation can be longer than any other cutters on the drill bit.

By using one or more of the innermost cutters described in this disclosure, a drill bit can be used to generate a series of micro cores as the drilling progresses. Forming these micro cores as part of the drilling process may increase the overall efficiency of the drilling process due in part to an increased susceptibility of the micro core to be fractured from the foundation material being drilled and/or conveyed away from the terminus of the borehole in one larger size piece of material. In addition, the larger single piece of foundation material included as part of the micro cores being generated by the drilling process may allow for easier capture and testing of the materials being generated at any particular stage of the drilling process. By generating a rock sample that is easier to remove from the borehole and to perform testing on, the embodiments of the drill bits as described in this disclosure may increase the efficiency and effectiveness of a coring procedure during drilling.

FIG. 1A is an elevation view of a drilling system with a drill bit with cutters. A drilling system 100 is configured to drill into one or more geological formations to form a wellbore 107*a*, 107*b*, sometimes also referred to as a borehole. The drilling system 100 can include a drill bit 101 and a well site 106. Drill bit 101 may comprise any embodiments of the drill bits described in this disclosure, or any equivalents thereof, including drill bits configured with one or more innermost cutters as described in this disclosure, or any equivalents thereof, which may be configured to generate micro cores as part of a drilling operation. Various types of drilling equipment such as a rotary table, mud pumps and mud tanks (not expressly shown) can be located at the well surface or well site 106. The well site 106 can include a drilling rig 102 that can have various characteristics and features associated with a "land drilling rig". However, other drill bits can be satisfactorily used with drilling equipment located on offshore platforms, drill ships, semi-submersibles and drilling barges.

The drilling system 100 can include a drill string 103 associated with the drill bit 101 that can be used to rotate the drill bit 101 in a radial direction 105 around a bit rotational axis 104 of form a wide variety of wellbores 107*a*, 107*b*; such as a generally vertical wellbore 107*a* or a generally horizontal wellbore 107*b* as shown in FIG. 1A. Various directional drilling techniques and associated components of a bottom hole assembly (BHA) 120 of the drill string 103 can be used to form the generally horizontal wellbore 107*b*. For example, lateral forces can be applied to the drill bit 101 proximate a kickoff location 113 to form the generally horizontal wellbore 107*b* extending from the generally vertical wellbore 107*a*. Each of the wellbores 107*a*, 107*b* can be drilled to a drilling distance, which is the distance between the well surface and the furthest extent of each of the wellbores 107*a*, 107*b*, respectively.

The BHA 120 can be formed from a wide variety of components configured to form the wellbores 107*a*, 107*b*. For example, the components 121*a*, 121*b* and 121*c* of BHA 120 can include, but are not limited to the drill bit 101, drill collars, rotary steering tools, directional drilling tools, downhole drilling motors, reamers, hole enlargers or stabilizers. The number of components such as drill collars and different types of components 121*a*, 121*b*, 121*c* included in the BHA 120 can depend upon anticipated downhole drilling conditions and the type of wellbore that will be formed by the drill string 103 and the drill bit 101. The wellbore 107*a* can be defined in part by a casing string 110 that can extend from the well site 106 to a selected downhole location. Various types of drilling fluid can be pumped from the well site 106 through the drill string 103 to the drill bit 101. The components 121*a*, 121*b*, and 121*c* can be attached to the drill bit 101 at an uphole end 158 of the drill bit 101.

Drilling fluids can be directed to flow from the drill string 103 to respective nozzles included in the drill bit 101. The drilling fluid can be circulated back to the well site 106 through an annulus 108 defined in part by an outside diameter 112 of the drill string 103 and an inside diameter 111 of the casing string 110. The drill bit 101 can include a plurality of blades 152*a*-152*g*. Each of the plurality of blades 152*a*-152*g* can be disposed outwardly from the exterior of a bit body 151 of the drill bit 101. Each of the plurality of blades 152*a*-152*g* can include a set of cutters 153 that can drill away material surrounding the drill bit 101 in a downhole direction 159. The bit body 151 can be generally cylindrical and the blades 152*a*-152*g* may comprise any suitable type of projections extending outwardly (i.e. in a radial direction from the bit rotational axis 104) from the bit body 151. The arrangements of the blades and/or the circulation of the drilling fluids may be utilized in various embodiments to urge fractured micro cores away from a bottom area and/or the recessed central area of the drill bit as further described below, for example to enable more efficient drilling and/or allow for capture and inspection/testing/and other analysis of the captured micro cores being generated as part of a drilling operation.

Figure 1B:
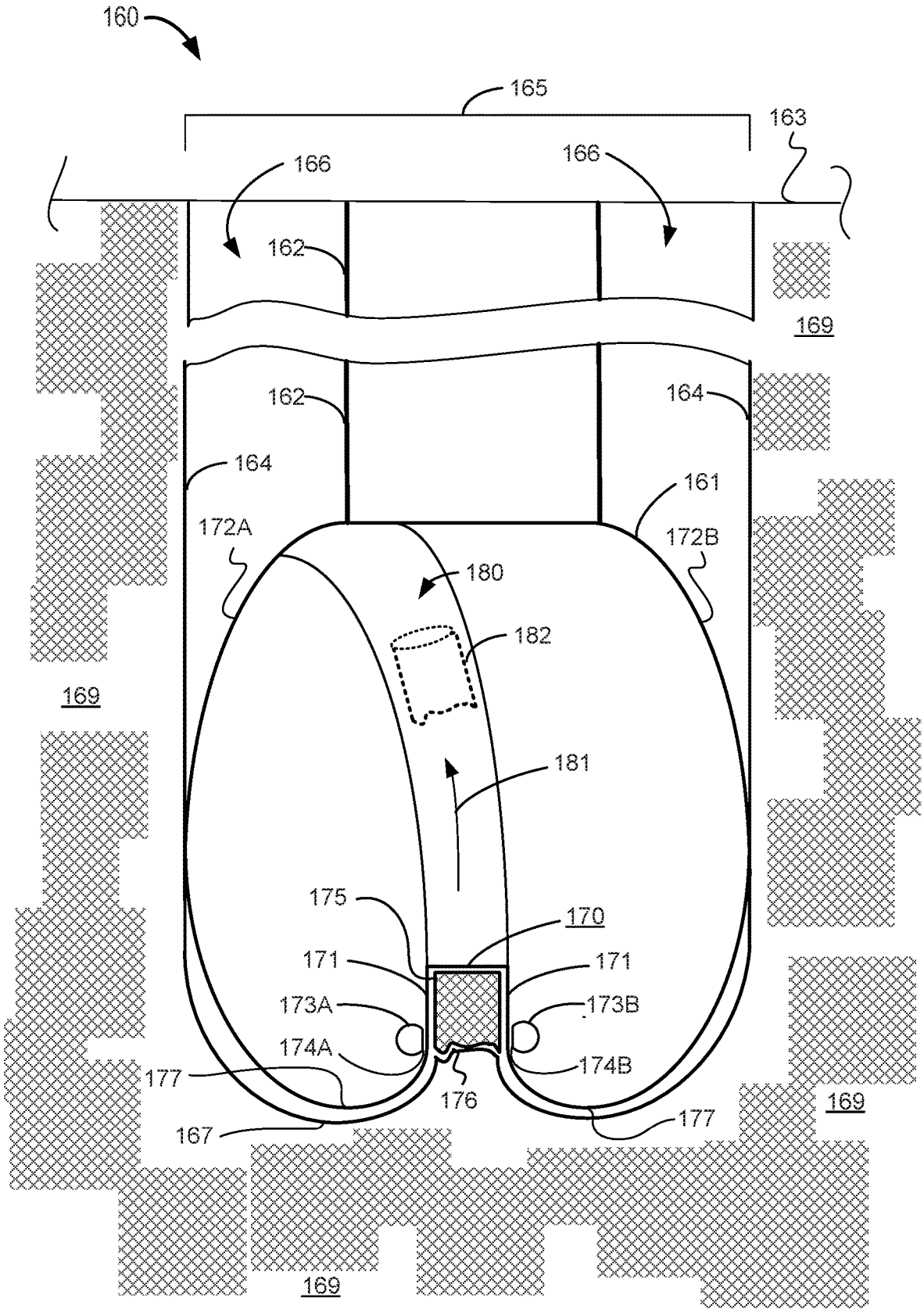
FIG. 1B is a diagram illustrating a drill bit in accordance with various embodiments of the disclosure.

FIG. 1B is a diagram 160 illustrating a drill bit 161 in accordance with various embodiments of the disclosure. Drill bit 161 may be an embodiment of drill bit 101 that may be included as part of drilling system 100 as illustrated and described with respect to FIG. 1A. Referring back to FIG. 1B, drill bit 161 may include any of the features, such as cutters and reliefs, arranged to perform any of the functions and/or to provide any of the features of the drill bits and cutters as illustrated and described throughout this disclosure, and any equivalents thereof.

As illustrated in FIG. 1B, diagram 160 includes drill bit 161 coupled to a drill collar 162 that may include a plurality of drill pipes forming a drill string and extending into a borehole, the borehole generally indicated as the borehole below a bracket indicated by reference number 165, (hereinafter "borehole 165"). Borehole 165 includes borehole walls 164 that extend from surface 163 to a terminus 167 of the borehole. As shown in FIG. 1B, the terminus 167 of borehole 165 has a shape that generally conforms to contours of a distal or "bottom" portion 177 of drill bit 161. Embodiments of drill bit 161 may include one or more blades, illustrated in FIG. 1B as blades 172A and 172B. Each of blades 172A and 172B includes a plurality of cutters (not shown in FIG. 1B for clarity sake, but for example cutters 203, FIG. 2). Each of blades 172A, 172B includes a respective inner most cutter 173A, 173B. Inner most cutters 173A and 173B are positioned adjacent to sidewalls 171 of a recessed central opening in the bottom portion of drill bit 161, the sidewalls extending from a bottom portion 177 of the drill bit to a central drill bit surface 170 that is recessed away from the bottom portion of the drill bit. As shown in FIG. 1B, the sidewalls 171 are spaced around the recessed central opening in the bottom portion 177 of the drill bit 161 so that as the drill bit is operated to extend the borehole 165 further into formation 169, a micro core 175 is formed from a portion of the formation cut away on the sides by the innermost cutters 173A and 173B. Micro core 175 extends into the recessed central opening and toward central drill bit surface 170 of drill bit 161. In some embodiments, the shape of micro core 175 is generally an upright cylinder, although embodiments of micro core 175 are not necessarily limited to having an upright cylindrical shape. As further described below, inner most cutters 173A, 173B include at least one relief, illustrated in FIG. 1B as reliefs 174A, 174B, respectively. The reliefs having a particular shape, such as but not limited to a non-circular or a non-elliptical shape, that is configured to produce a side force on micro core 175 as part of the drilling operation. This side force may contribute to producing a fracture 176 that separates micro core 175 from the remainder of formation 169. In various embodiments, the drilling process utilizing drill bit 161 may progress downward within borehole 165 to the extent that the micro core 175 comes into direct contact with the central drill bit surface 170. Pressure applied to the micro core 175 by the contact with central drill bit surface 170 may contribute to producing the fracture 176 that separates micro core 175 from the remainder of formation 169. In other embodiments, inner most cutters 173A, 173B may fracture the micro core 175 without and/or before the micro core 175 comes into contact with central drill bit surface 170 of drill bit 161.

Once separated from formation 169, a micro core such as micro core 175 may be urged upward through an escapeway 180 between blades 172A and 172B, for example by a fluid pressure generated by a fluid, such as drilling mud, that is being expelled from the drill bit 161 through one or more nozzles (not specifically shown in FIG. 1B, but for example one or more nozzles 256, FIG. 2) in the drill bit. A fractured micro core generated by the operation of drill bit 161 may be urged to move along escapeway 180 in the direction indicated by arrow 181, (as generally illustrated by micro core 182), toward annulus 166 located between borehole walls 164 and drill collar 162, and be expelled at surface 163. As micro core 175 is removed from the central area and/or bottom area of drill bit 161 and as drilling progresses, additional micro cores may be formed by inner most cutters 173A, 173B. These additional micro cores may then be fractured from formation 169, and removed from the bottom area of drill bit 161 as described above. The ability of drill bit 161 to repeat the process of producing, fracturing, and removing micro cores from the bottom area of the drill bit 161 and the borehole terminus 167 may provide any of the features and advantages as described throughout this disclosure, such as more efficient drilling and/or the ability to determine a drilling/formation status as a result of and as related to micro core drilling and drill bits.

Figure 2:
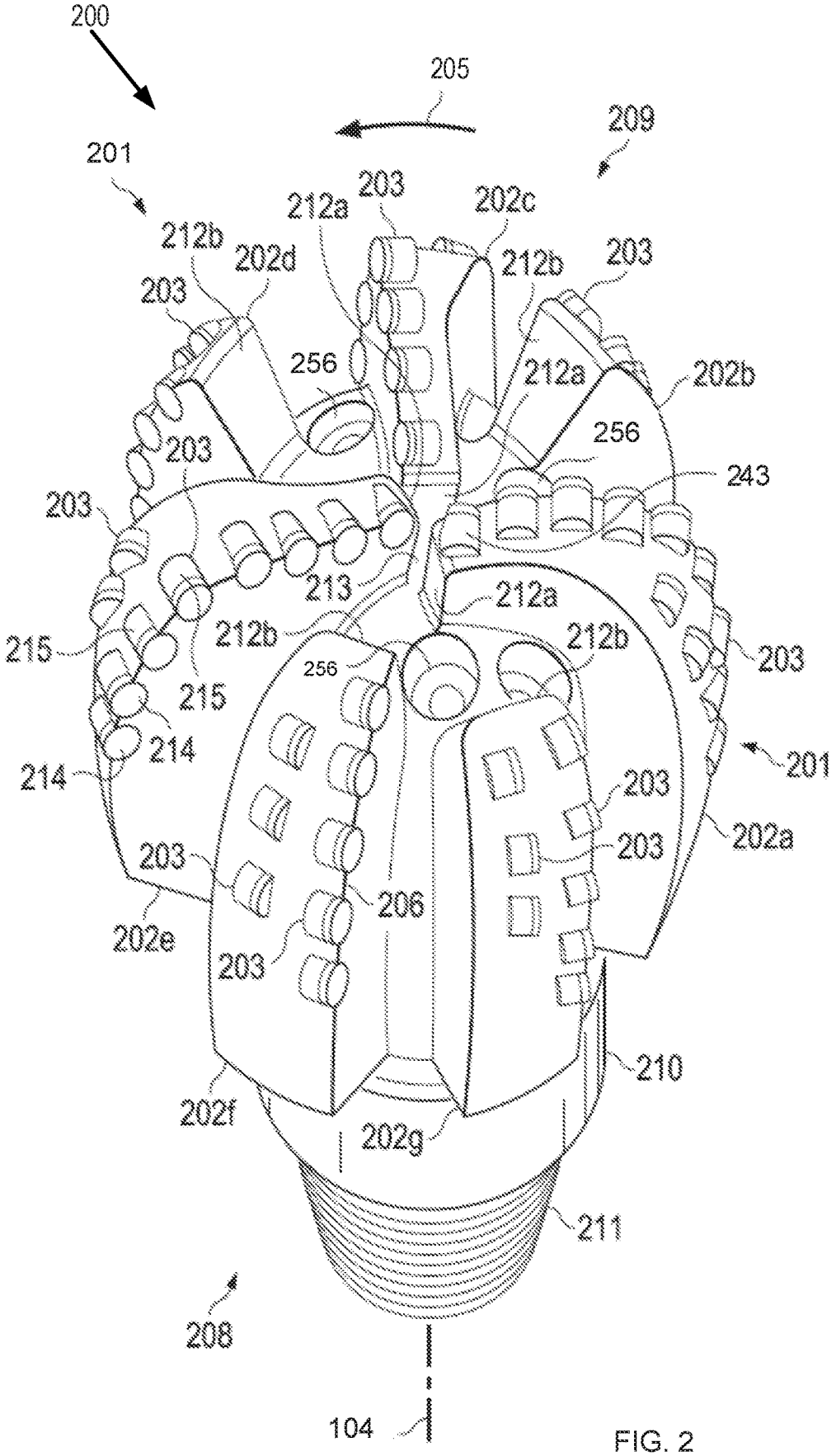
FIG. 2 is an isometric view of a fixed-cutter drill bit with cutters.

FIG. 2 is an isometric view of a fixed-cutter drill bit with cutters. In various embodiments, drill bit 200 may be similar to or the same as drill bit 101 as illustrated and described with respect to FIG. 1A. In various embodiments, drill bit 200 may be similar to or the same as drill bit 161 illustrated and described with respect to FIG. 1B.

Referring back to FIG. 2, drill bit 200 can be designed and formed in accordance with various embodiments and can have many different designs, configurations, and/or dimensions according to the particular application of the drill bit 200. An uphole end 208 of the drill bit 200 can include a shank 210 with threads 211 formed thereon. In some embodiments, the threads 211 can be used to releasably engage the drill bit 200 with a BHA. For example, with reference to FIG. 1A, the threads 211 can releasably engage with the BHA 120, whereby the drill bit 200 can rotate relative to a bit rotational axis 204. In some embodiments, with reference to FIG. 1A, the bit rotational axis 204 can be the same as the bit rotational axis 104. A downhole end 209 of the drill bit 200 can include a plurality of blades 202*a*-202*g* with respective junk slots or fluid flow paths disposed therebetween. Additionally, drilling fluids can be communicated via one or more nozzles 256.

The plurality of blades 202 (e.g., blades 202*a*-202*g*) can be disposed outwardly from the exterior of a bit body 201 of the drill bit 200. The bit body 201 can be generally cylindrical and the blades 202 can be any suitable type of projections extending outwardly (i.e. in a radial direction from the bit rotational axis 204) from the bit body 201. For example, a portion of each blade 202 can be coupled to the exterior of the bit body 201, while another portion of each blade 202 projects away from the exterior of the bit body 201. The blades 202 can have a wide variety of configurations including, but not limited to, substantially arched, helical, spiraling, tapered, converging, diverging, symmetrical, and/or asymmetrical.

In some cases, one or more blades 202 can have a substantially arched configuration extending from proximate the bit rotational axis 204 of the drill bit 200. The arched configuration can be defined in part by a generally concave, recessed shaped portion extending from a location proximate to the bit rotational axis 204. The arched configuration can also be defined in part by a generally convex, outwardly curved blade portion disposed between the concave, recessed blade portion and outer portions of each blade which correspond generally with the outside diameter of the rotary drill bit.

The blades 202*a*-202*g* can include primary blades disposed about the bit rotational axis. For example, the blades 202*a*, 202*c*, and 202*e* can be primary blades or major blades, wherein the inner end 212*a* of the blade 202*a*, the blade 202*c*, and the blade 202*e* can be disposed closely adjacent to the bit rotational axis 204 and closer to the bit rotational axis 204 than the remainder for the respective blades. The blades 202*a*-202*g* can also include at least one secondary blade ("minor blade") disposed between the primary blades. Thus, the blades 202*b*, 202*d*, 202*f*, and 202*g* shown in FIG. 2 on the drill bit 200 can be secondary blades, wherein the inner end of a secondary blade is not as close to the bit rotational axis 204 as the inner end of a primary blade. For example, the inner ends 212*b* of the secondary blades 202*b*, 202*d*, 202*f*, 202*g* can be disposed on the downhole end 209 of the drill bit 200 at a distance from the bit rotational axis 204 that is at least 1.5 times, at least 2 times, at least 3 times, or between 1.5 and 5 times, between 2 and 5 times, or between 3 and 5 times, inclusive, of the distance of the farthest of inner ends 212*a* of the primary blades 202*a*, 202*c*, 202*e* from the bit rotational axis 204. The number and location of secondary blades and primary blades can vary such that the drill bit 200 includes fewer or greater secondary and primary blades than are shown in FIG. 2, and the number of primary blades can be greater or less than the number of secondary blades. The blades 202 can be disposed symmetrically or asymmetrically with regard to each other and the bit rotational axis 204, where the disposition can be based on the downhole drilling conditions of the drilling environment.

The inner ends 212*a* of the blades 202*a*, 202*c*, and 202*e*, are disposed closely adjacent to the bit rotational axis 204. The inner ends 212*a*, along with a portion of the bit body 201, form a central bit surface 213. During drilling, formation material adjacent the central bit surface 213 can either fracture and degrade with the surrounding formation during drilling, or it can form a short column of uncut formation. If a column of uncut formation is formed, the central bit surface 213 can crush or destroy the column of uncut formation as drilling progresses. In some embodiments, the column of uncut formation can be free from the drill bit 200 and can remain unmoved by circulation fluid that circulates solid material to the surface of the wellbore 107.

The central bit surface 213 can be adapted to limit wear if it crushes or destroys uncut formation or as a result of drilling fluid flow. For example, portions of the central bit surface 213, such as the inner ends 212*a*, a portion of the bit body 201, or an outer portion of the one or more nozzles 256, can be formed from or layered with a superhard material, wherein a superhard material can be defined as any material having an abrasion toughness and/or fracture toughness that exceeds tungsten carbide. For example, superhard materials can include diamond, a PDC, and/or various hardened ceramic materials. Any two, a plurality of, or all of the inner ends 212*a* can have a longest distance from one another through the bit rotational axis 204 that is approximately between 0.0 and 0.5 inches. Alternatively, any two, a plurality of, or all of the inner ends 212*a* can have a longest distance from one another, as measured through the bit rotational axis 204, that is between 0 and 1/10 the total diameter of the drill bit 101. In drill bits wherein each of the inner ends of the blades are the same radial distance away from a bit rotational axis, the inner ends of any blades 202 attached to the bit 200 can be arranged and constructed in the same manner as the inner ends 212*a* as described herein.

The blades 202 and the drill bit 200 can rotate about the bit rotational axis 204 in the direction defined by directional arrow 205. Each blade 202 can have a leading (or front) surface disposed on one side of the blade in the direction of rotation of the drill bit 200 and a trailing (or back) surface disposed on an opposite side of the blade away from the direction of rotation of the drill bit 200. The blades 202 can be positioned along the bit body 201 such that they have a spiral configuration relative to the bit rotational axis 204. Alternatively, the blades 202 can be positioned along the bit body 201 in a generally parallel configuration with respect to each other and the bit rotational axis 204, as shown in FIG. 2.

The blades 202 include a set of cutters 203 disposed outwardly from outer portions of each blade 202. For example, a portion of the set of cutters 203 can be projected away from the exterior portion of blade 202. The set of cutters 203 may comprise any suitable device configured to cut into a formation, such as various types of compacts, buttons, inserts, and gage cutters known in the art to be used with a wide variety of fixed-cutter drill bits.

One or more of the cutters 203 can include a substrate with a layer of hard cutting material disposed on one end of the substrate 220. The layer of hard cutting material may comprise a superhard material, such as a PDC material. The substrate may comprise carbide, such as tungsten carbide. With reference to FIG. 1A, the layer of hard cutting material can provide a cutting surface 214 for cutter 203, a portion of which can engage adjacent portions of the formation to form a wellbore such as the wellbores 107*a*, 107*b*. The contact of the cutting surface 214 with the formation can form a cutting zone associated with each cutter 203. The edge of the cutting surface 214 located within the cutting zone can be referred to as the cutting edge of a cutter 203. If cutter 203 has a cutting surface that is circular or circular in cross-section, then the cutting edge will have an arced portion referred to as the cutting arc. The length of the arced portion of the cutting edge is referred to as the cutting arc length. Cutter 203 can also include a side surface 215. The cutters within the set of cutters 203 that are closest to one of the inner ends 212*a* can be considered innermost cutters. For example, cutter 243 is the closest cutter to one of the inner ends 212*a* relative to any other cutter on the blade 202*a*, and can thus be considered as an innermost cutter.

Figure 3:
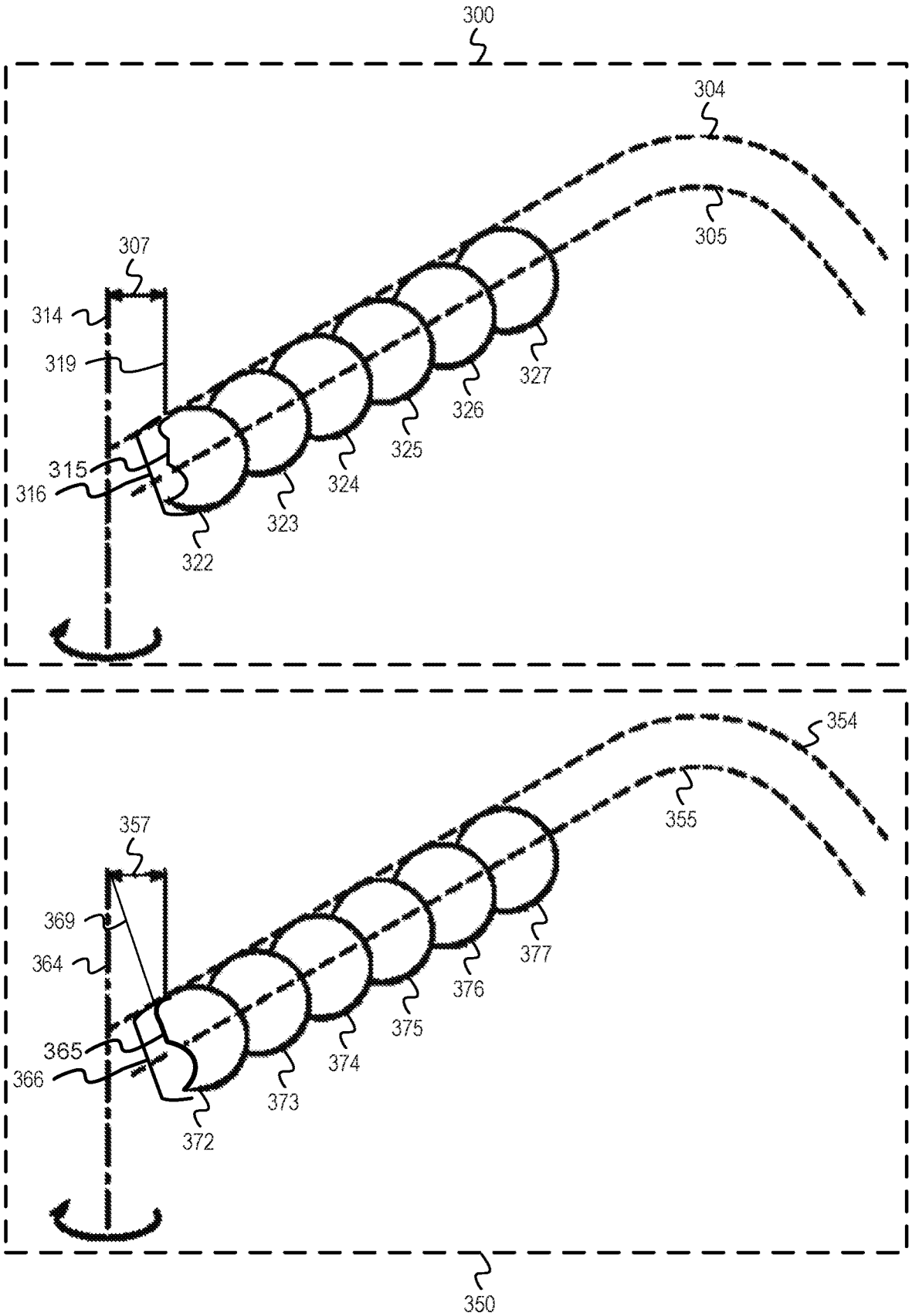
FIG. 3 includes a set of profiles corresponding to the cutters and blades on a drill bit.

FIG. 3 includes a set of profiles corresponding to the cutters and blades on a drill bit. FIG. 3 includes a dashed box 300 and a dashed box 350. The dashed box 300 shows a cutter profile 304, blade profiles 305 and a set of cutters 322-327. The blade profiles 305 correspond to the exterior surfaces of the blades near the cutters 322-327. For example, with reference to FIG. 2, the blade profiles 305 can correspond to the exterior surfaces of the blades 202*a*-202*c*. The set of cutters 322-327 includes the innermost cutter 322. The innermost cutter 322 is located closest to the bit rotational axis 314 with respect to all of the cutters in the set of cutters 322-327. Each of the innermost cutters can have a cutting arc that can comprise of either connected or disconnected segments from each other, wherein the cutting arc of a cutter can be the collective portion of a cutter surface boundary that cuts a formation during drilling. In some embodiments, the total cutting arc length of an example cutter can be less than a flat circular or oval cutting arc length that would be exhibited if the cutting surface of the example cutter were entirely circular or oval.

The innermost cutter 322 can include a flat surface 315 that is located within and interrupts the cutting arc 316 of the innermost cutter 322 such that the cutting arc has at least two portions located at opposite ends of the flat surface 315. In addition, the innermost cutter 322 has a reduced cutting arc length as compared to a flat circular cutting arc length of a similar cutter with a cutting surface that is flat and/or entirely circular, such as the cutting surface of the cutter 327. As a result, a combined track profile of a drill bit having the innermost cutter 322 can be reduced on the side adjacent to the bit rotational axis 314, as shown by the innermost cutter 322. The profile of the innermost cutter 322 can be circular throughout the majority of the profile, and non-circular in an area corresponding to the flat surface 315 on the side adjacent the bit rotational axis 314 and generally parallel to the bit rotational axis 314, such that the non-circular profile can form an angle of within +/−3° of the bit rotational axis 314, wherein the angle can be represented by the angle formed between the bit rotational axis 314 and the profile line 319).

The dashed box 350 shows a cutter profile 354, blade profiles 355 and a set of cutters 372-377. The blade profiles 355 correspond to the exterior surfaces of the blades near the cutters 372-377. For example, with reference to FIG. 2, the blade profiles 355 can correspond to the exterior surfaces of the blades 202. The set of cutters 372-377 includes the innermost cutter 372. The innermost cutter 372 is located closest to the bit rotational axis 364 with respect to all of the cutters in the set of cutters 372-377.

The innermost cutter 372 can include a relief 365 that is located within and interrupts its cutting arc 366 so that the cutting arc has at least two portions located at opposite ends of the relief 365. In addition, the innermost cutter 372 has a reduced cutting arc length as compared to a flat circular cutting arc length of a similar cutter with a cutting surface that is both flat and entirely circular, such as the cutting surface of the cutter 377. As a result, a drill bit having the innermost cutter 372 can have a track diagram in which the profile of the innermost cutter 372 is reduced on the side adjacent to the bit rotational axis 364, as shown in the innermost cutter 372. The profile of the innermost cutter 372 can be non-circular in an area corresponding to the relief 365 on the side adjacent the bit rotational axis 364 and its corresponding profile line 369 can form an acute angle with the uphole end of the bit rotational axis 364. The acute angle can be greater than 3° and less than or equal to of 35°, or greater than 3° and less than or equal to 10°. While depicted with one relief 365, the innermost cutter 372 can have multiple reliefs. The non-circular profile in an area corresponding to the relief 365 can include both curved and straight edges.

The non-circular cutter profiles in areas corresponding to the flat surface 315 or the relief 365 can reduce the surface area of their respective profiles as compared to circular cutter profiles. For example, the flat surface 315 and/or the relief 365 can reduce the surface area of their respective cutters 322, 372 by at least 5%, at least 10%, at least 30%, or by between 5% and 45%, between 5% and 30%, between 10% and 45%, between 10% and 30%, between 30% and 45%, inclusive. For example, the closest distance 307 between the innermost cutter 322 and the bit rotational axis 314 can be between 0 centimeters and five centimeters, inclusive. The closest distance 357 between the innermost cutter 372 and the bit rotational axis 364 can be between 0 centimeters and five centimeters, inclusive. In some embodiments, the closest distance 307 between the innermost cutter 322 and the bit rotational axis 364 can be a ratio up to 0.3 of the radius of the drill bit body. In some embodiments, the closest distance 357 between the innermost cutter 372 and the bit rotational axis 364 can be a ratio up to 0.3 of the radius of the drill bit body.

The innermost cutter 322, 372 can have a flattened cutting surface with a flat surface 315, or relief 365 that can be wavy, angled, or curved. In addition, the innermost cutter 322, 372 can have more than one relief, allowing the cutter to be rotated in a socket in a drill bit once it is worn on one side, and after rotation, used to continue drilling without replacement of the innermost cutter 322, 372. If the innermost cutter 322, 372 was rotated so that an alternate relief were located in the cutting area, then the alternate relief can have an associated and similar cutting arc length. In some embodiments, a cutter can have multiple reliefs, wherein each of the multiple reliefs have similar or identical geometry. In some embodiments, a different relief can be placed at regular intervals around the circumference of innermost cutter 322. For example, a cutter can have reliefs with relief centers on opposite sides of the cutting surface (i.e. spaced radially 180 degrees from one another). As an additional example, a cutter can have three reliefs with relief centers spaced radially 120 degrees from one another.

Figure 4A:
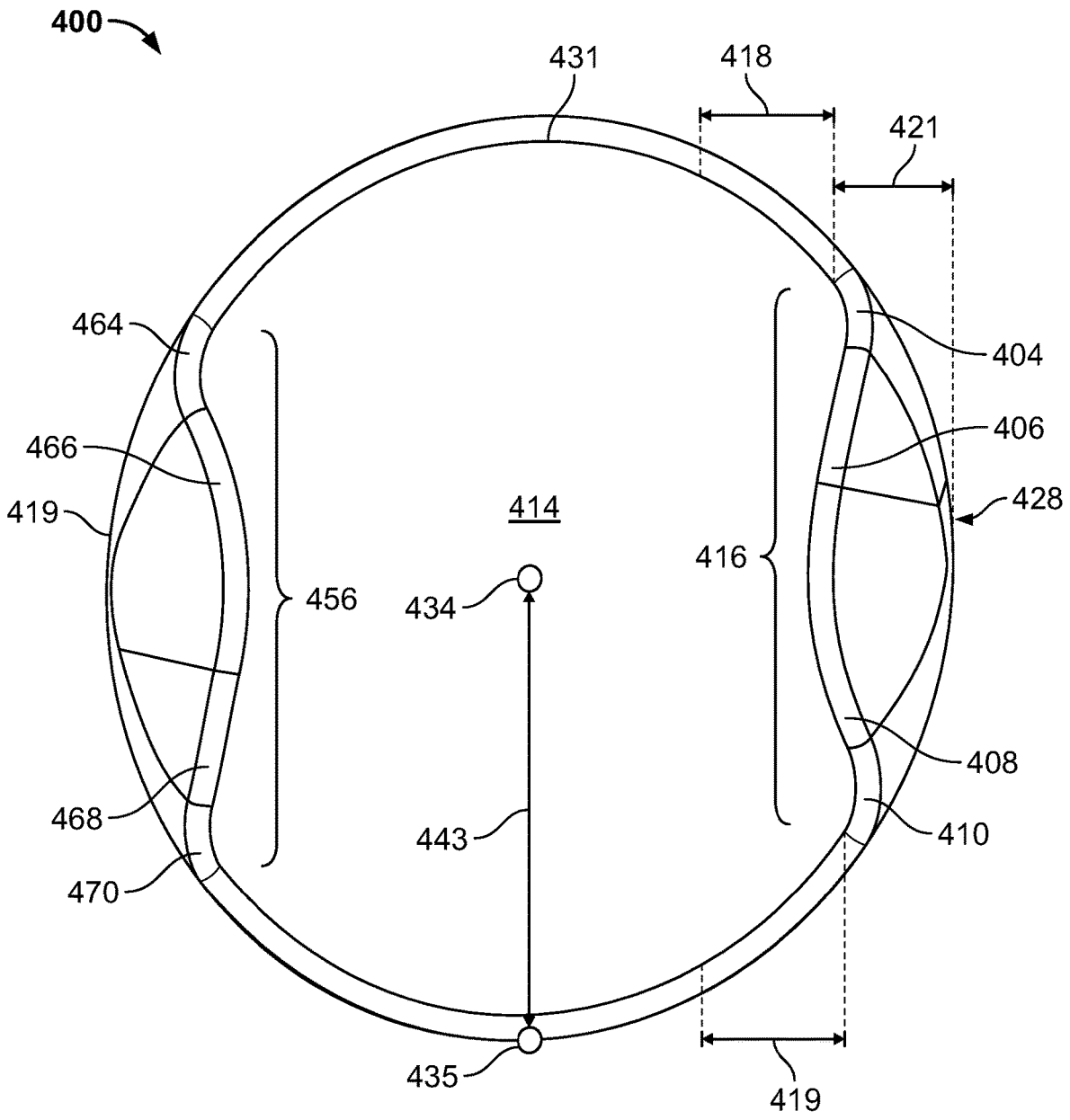
FIG. 4A depicts a first view of an embodiment of a first innermost cutter.
Figure 4B:
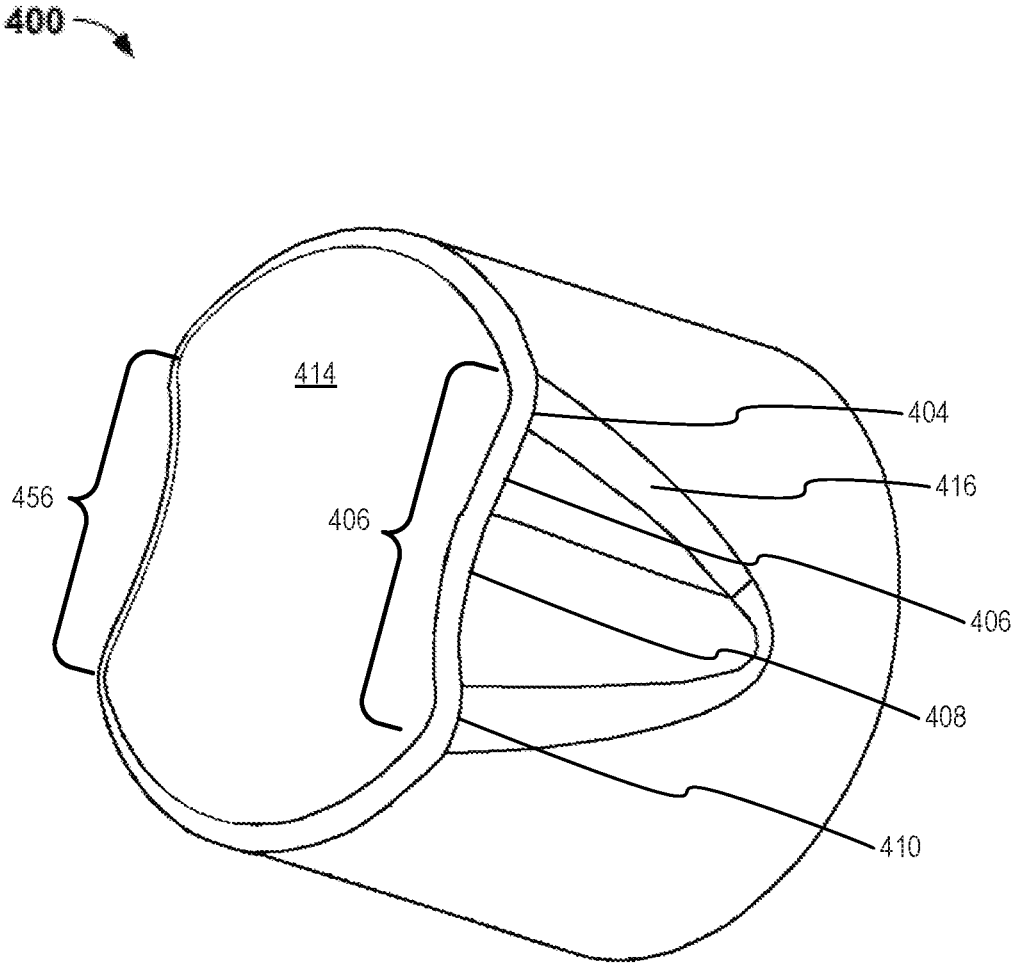
FIG. 4B depicts a second view of the embodiment of the first innermost cutter.

FIG. 4A depicts a first view of an embodiment of a first innermost cutter. FIG. 4A is a top view a cutter 400, which can serve as an example of the innermost cutter 322 or the innermost cutter 372 of FIG. 3. FIG. 4B is an isometric view of the cutter 400. The cutter 400 includes a relieved cutting surface 414 having a first relief 416 and a second relief 456. In some embodiments, the relieved cutting surface 414 can include one or more reliefs such that each relief creates an angle between the edge of the relief that defines a portion of the face, and the edge of the relief that defines a portion of the side of the cutter. The first relief 416 and the second relief 456 can have various shapes and dimensions. For example, each of the first relief 416 and the second relief 456 can start at approximately 10% of the radius from the center 434 of the relieved cutting surface 414 to the edge 431 at an angle between 1-5 degrees, wherein the radius can be the maximum distance 443 from the cutting surface center 434 to the cutting surface edge point 435.

The first relief 416 can have a maximum radial distance 421 from a circular or oval cutting surface edge that would be present if the cutting surface 414 were entirely circular or oval. In some embodiments, the maximum radial distance 421 can be between ¼ and ⅘ inclusive, or between ⅓ and ⅘, inclusive of the radius or major axis of the cutting surface 414 absent the relief. The second relief 456 can have a similar maximum radial distance. The relieved cutting surface 414 can have a total cutting arc length equal to the sum of the length of the two circular portions 418 and 419. In some embodiments, the total cutting arc length can be less than a flat circular or oval cutting arc length that would be exhibited if the cutting surface 414 were entirely circular or oval.

The relieved cutting surface 414 can be flattened and circular or oval over the majority of cutting surface 414, with the exception of a first relief 416 and a second relief 456, which are located within and interrupt the cutting arc of the cutter 400. In this example, the first relief 416 is nonlinear and includes a curved edge 404, a straight edge 406, a curved edge 408, and a curved edge 410. The curved edge 404 can be convex relative to the center of the innermost cutter 400 and can be positioned at a first end of the first relief 416.

A first end of the curved edge 408 can be positioned adjacent to the straight edge 406 (at an end that is opposite the end of straight edge 406 that is adjacent to the curved edge 404). Additionally, a second end of the curved edge 408 is positioned at a first end of the curved edge 410. A second end of the curved edge 410 can be positioned at a second end of the first relief 416. The curved edge 408 can fracture a micro core that has been formed by the cutter 400 under side load to failure. Additionally, similar to the curved edge 404, the curved edge 408 and the curved edge 410 can cooperate to increase the toughness of the cutter 400. In some embodiments, the micro core can be rock material having a diameter that is between 10 and 40 millimeters. In some embodiments, the micro core can be rock material having a diameter based on a ratio of the radius of the drill bit used to form the micro core.

The first relief 416 can include a modified edge that reduces the arc length of rock engagement to create a micro core. The contour of the first relief 416 can increase edge toughness based on the curved edge 404, wherein the contour of the first relief 416 is structured in an order comprising a curved contour portion, straight contour portion, and curved contour portion. The straight edge 406 of the first relief 416 can also reduce the rock being drilled to generate a micro core. The curved edge 408 of the contour of the first relief 416 can also operate to fracture the micro core. In some embodiments, the height of the micro core can be dependent on the length of the straight edge. The first relief 416 can have a maximum radial distance 421 from a circular or oval cutting surface edge that would be present if the cutting surface 414 were entirely circular or oval, that is between ⅕ and ⅘ inclusive, or between ⅓ and ⅘, inclusive of the radius or major axis of the cutting surface 414 absent the relief.

The curved edge 408 and the curved edge 404 can increase the toughness of the cutter 400 by distributing stress from the loading of the cutter 400 during drilling operations. The straight edge 406 can be positioned adjacent to the curved edge 404. The straight edge 406 can be positioned in the first relief 416 to create a mini core of the rock from the formation being cut. In some embodiments, a length of the straight edge 406 is proportional to a diameter of the cutter 400. For example, if the diameter of the cutter 400 increases to be two times larger, the length of the straight edge 406 can also be increased to be two times larger.

The cutter 400 includes the second relief 456. The second relief 456 can be dimensioned and arranged similar to the first relief 416, or as a mirror image of the first relief 416. Accordingly, instead of replacing the cutter 400 when the relief 416 is damaged, the cutter 400 can be rotated 180 degrees so that the second relief 456 is positioned in place of the first relief 416. The second relief 456 then becomes the active relief. The second relief 456 can be nonlinear and can include a curved edge 464, a straight edge 466, a straight edge 468, and a curved edge 470.

In some embodiments, the second relief 456 can include a modified edge that reduces the arc length of rock engagement to create a micro core during drilling operations. Accordingly, the contour of the second relief 456 can increase the toughness of the edge as a result of cooperation between the curved edges 464 and 470. The contour of the second relief 456 can reduce the rock being drilled to a micro core via cutting forces applied by the straight edge 466. The contour of the second relief 456 can also operate to fracture the micro core under side load generated by the straight edge 468. While the sections of the cutting surface 414 not intersected by the reliefs 416 and 456 are shown as circular, relieved cutting surface 414 can be ovoid in some embodiments.

In some embodiments, the curved edge 464 can be convex and can be positioned at a first end of the second relief 456. The straight edge 468 can increase the toughness of the cutter 400 to reduce cracking of the cutter 400 during drilling operations. The straight edge 466 can be positioned adjacent to the curved edge 464. The straight edge 466 can be positioned in the second relief 456 to create a mini core from the rock of the formation being cut. In some embodiments, a length of the straight edge 466 is proportional to a diameter of the cutter 400. For example, if the diameter of the cutter 400 is doubled, the length of the straight edge 466 can also be doubled.

A first end of the straight edge 468 can be positioned adjacent to the straight edge 466, wherein the first end of the straight edge 468 can be at an end that is opposite to the end that is adjacent to the curved edge 464. Additionally, a second end of the straight edge 468 can be positioned at a first end of the curved edge 470. A second end of the curved edge 470 can be positioned at a second end of the second relief 456. The curved edge 466 and/or the curved edge 408 can operate to fracture the generated micro core under side load to failure. Additionally, similar to the curved edge 464, the straight edge 468 and the curved edge 470 can provide additional toughness for the cutter 400, wherein a curved edge can be used instead of a straight edge at the position of the straight edge 468.

Although the cutter 400 is depicted as having a flattened cutting surface for which the cutting arc length or the surface area can be compared to having a portion of a circle or an oval, other portions of flattened cutting surface shapes, such as a portion of a polygon can be used in place of a circle or an oval. Alternatively, or in addition, an innermost cutter can have an irregular flattened cutting surface with a reduced cutting arc length or a reduced surface area. The cutting arc length for an innermost cutter can be compared to what it would be as calculated using a best fit cutting arc length of a best fit circle, oval, or polygon with less than ten sides for the flattened cutting surface absent the relief. For these above comparisons, the cutting arc length or surface area of the flattened cutting surface can be reduced by at least 5%, at least 10%, at least 20%; or by between 5% and 45%, between 5% and 30%, between 5% and 20%, between 10% and 45%, between 10% and 30%, between 20% and 30%, between 20% and 45%, or between 20% and 30%, inclusive as compared to the surface area of the best fit circle, oval, or polygon with less than ten sides absent the relief or reliefs.

The relief can extend laterally only through a portion of the layer of hard cutting material such as PDC, or it can extend laterally through all of the hard cutting material. If the relief extends laterally through all of the hard cutting material, it can then extend laterally through none, a portion of, or all of the substrate. In general, lateral extension of the relief through at most a portion of the substrate can facilitate attachment of the innermost cutter to a fixed-cutter drill bit by allowing the use of a circular pocket if the innermost cutter is circular in radial cross-section. However, extension of the relief through all of the substrate, coupled with a pocket having a wall that matches the shape of the relief, can facilitate proper placement of the innermost cutter with respect to the rotational axis of the bit. The relief can extend linearly and axially through the innermost cutter, so that it is at an approximately ninety-degree angle with respect to the cutting surface. The relief can also extend linearly at an obtuse angle with respect to the cutting surface. The relief 416 can also extend non-linearly in a shape, such as a curve, which generally forms an obtuse angle (as shown in FIG. 4A) with respect to the cutting surface 414.

Figure 5:
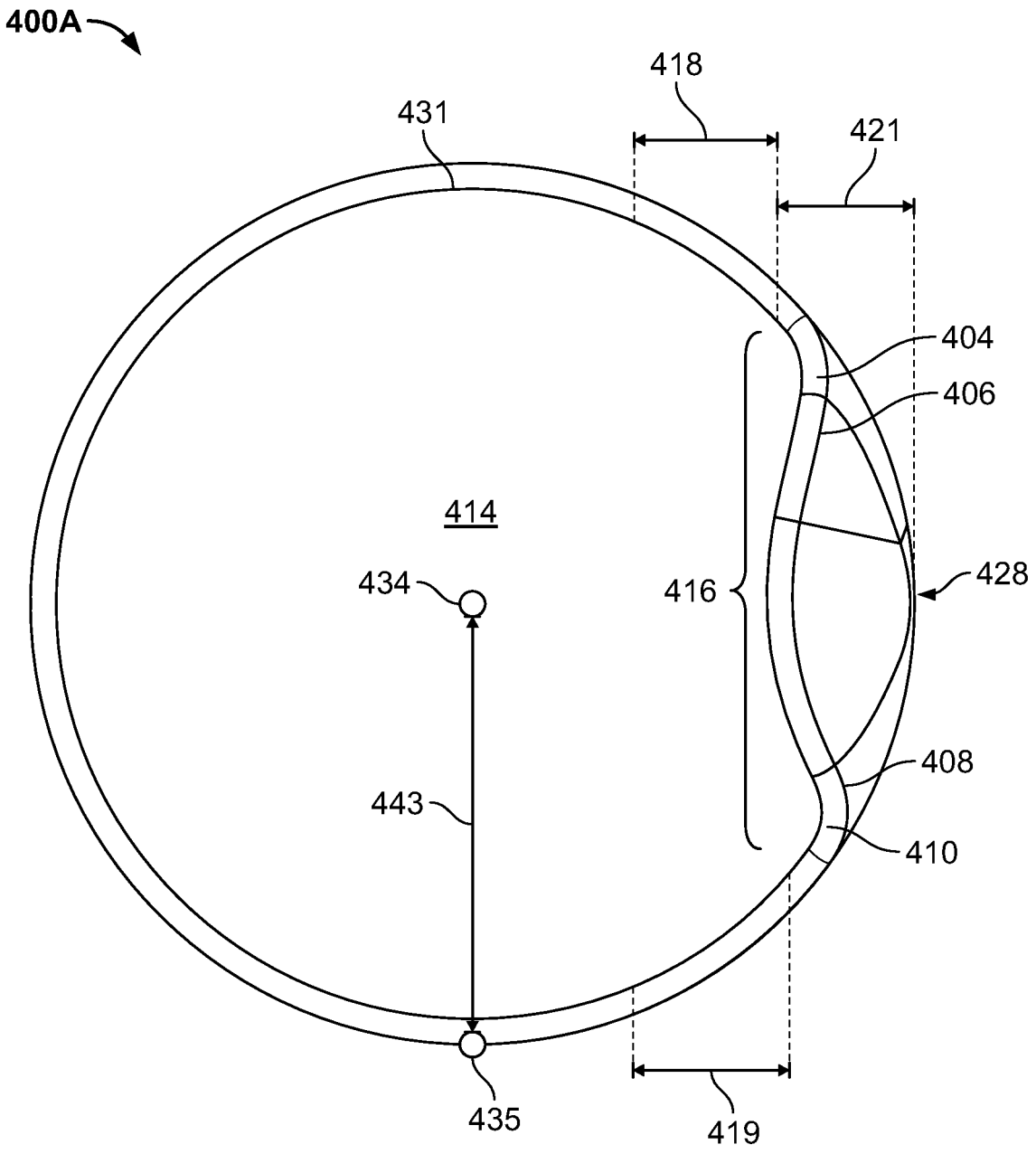
FIG. 5 depicts a view of another embodiment of a first innermost cutter.

Embodiments of cutter 400 may include a plurality of reliefs, for example but not limited to a set of two reliefs such as reliefs 416 and 456 as described above and as illustrated with respect to FIGS. 4A and 4B. Other embodiments of a cutter may include a cutter having just one single relief. FIG. 5 illustrates an example cutter 400A comprising a single relief 416. As shown in FIG. 5, cutter 400A includes the single relief 416 having a radial distance 421 that interrupts the circular or oval cutting surface edge 431 that would otherwise be continuously round or oval in shape if not for the presence of the relief 416. Relief 416 may include one or more, or any combination of, the elements described above with respect to relief 416 of cutter 400 and FIGS. 4A and 4B, and may be configured to perform one or more, or any combination of the functions ascribed to cutter 400.

Figure 6:
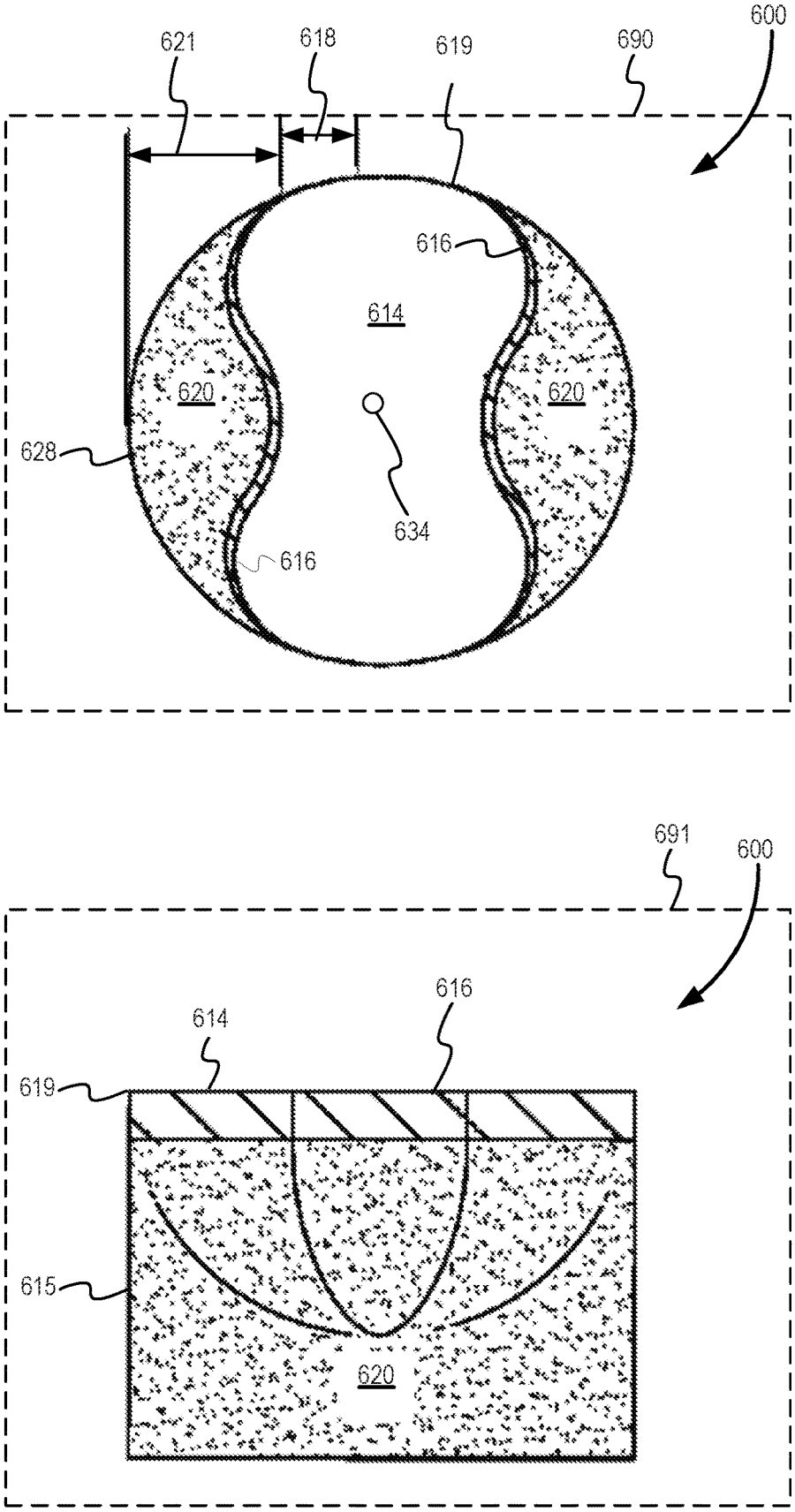
FIGS. 6-7 depict views of a second innermost cutter.
Figure 7:
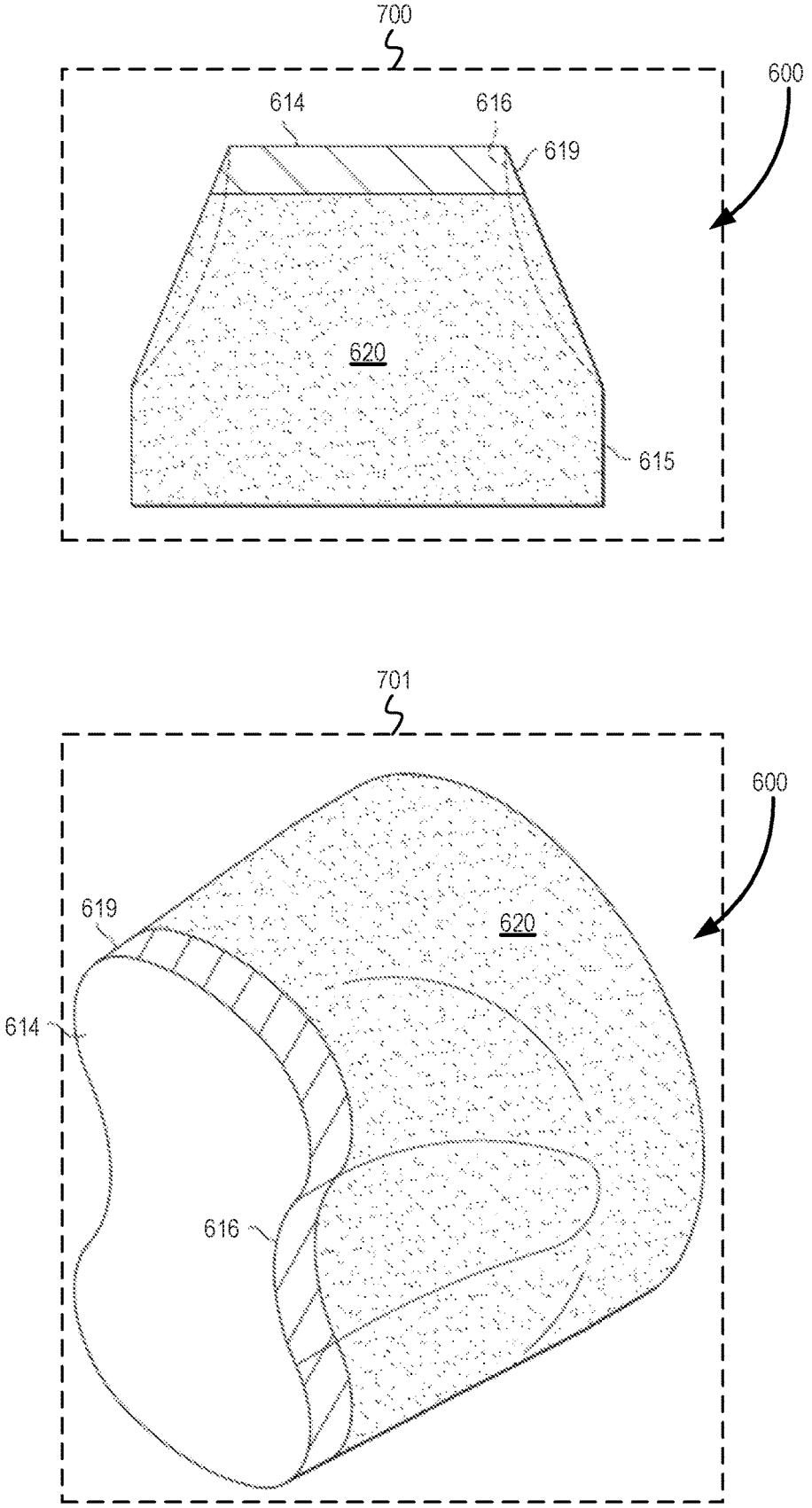

FIGS. 6-7 depict views of a second innermost cutter. FIG. 6 includes a dashed box 690 and a dashed box 691. FIG. 7 includes a dashed box 700 and a dashed box 701. The dashed box 690 includes a schematic cutting view of an innermost cutter 600. The dashed box 691 includes a schematic elevation view of the innermost cutter 600. The dashed box 700 depicts a schematic cross-sectional view of the innermost cutter 600. The dashed box 701 depicts a schematic isometric view of the innermost cutter 600. The innermost cutter 600 can be a cutter closest to a bit rotational axis. For example, with reference to FIG. 3, the innermost cutter 600 can be positioned at the position of the innermost cutter 322.

The innermost cutter 600 can have a wavy profile that extends inwards relative to the maximum radius of a flattened cutting surface 614 covering a substrate 620. In some embodiments, the innermost cutter 600 includes a circular portion 628 representing a circular portion of the innermost cutter 600 that comprises the substrate 620 but does not comprise the cutting surface 614. The flattened cutting surface 614 can have an edge 619, wherein the edge 619 can include both straight edge portions and flat edge portions. In some embodiments, reliefs 616 of the innermost cutter 600 can have a maximum radial distance 621 from a circular or oval cutting surface edge that would be present if the cutting surface 614 were entirely circular or oval. In some embodiments, the maximum radial distance 621 can be between ⅕ and ⅘ inclusive, or between ⅓ and ⅘, inclusive of the radius or major axis of the cutting surface 614 absent the reliefs 616.

The reliefs 616 can reduce the surface area of the flattened cutting surface 614 as compared to what the flattened cutting surface 614 would be if the flattened cutting surface 614 were entirely circular or oval. In some embodiments, the surface area of a cutting surface can be reduced relative to an entirely circular or oval cutting surface by at least 5%, at least 10%, at least 20%, or by between 5% and 45%, between 5% and 30%, between 5% and 20%, between 10% and 45%, between 10% and 30%, between 20% and 30%, between 20% and 45%, or between 20% and 30%, inclusive. For example, the reliefs 616 can reduce the surface of the flattened cuttings surface 614 by 30%. In some embodiments, the least length between the cutting surface 614 and the surface center 634 can be represented by the distance 618.

Figure 8:
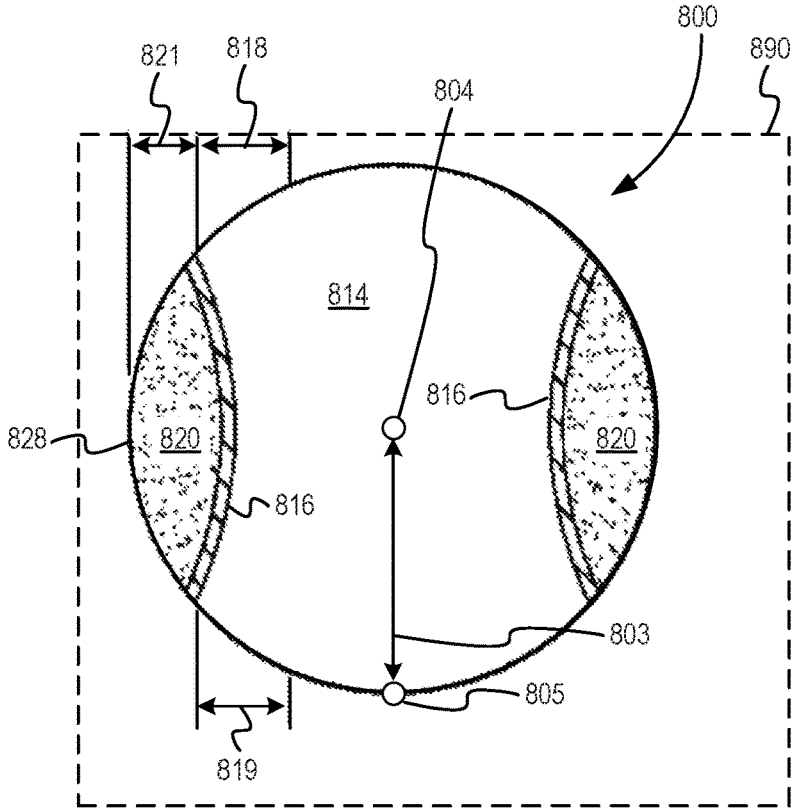
FIG. 8 includes views of a third innermost cutter and a fourth innermost cutter.
Figure 8:
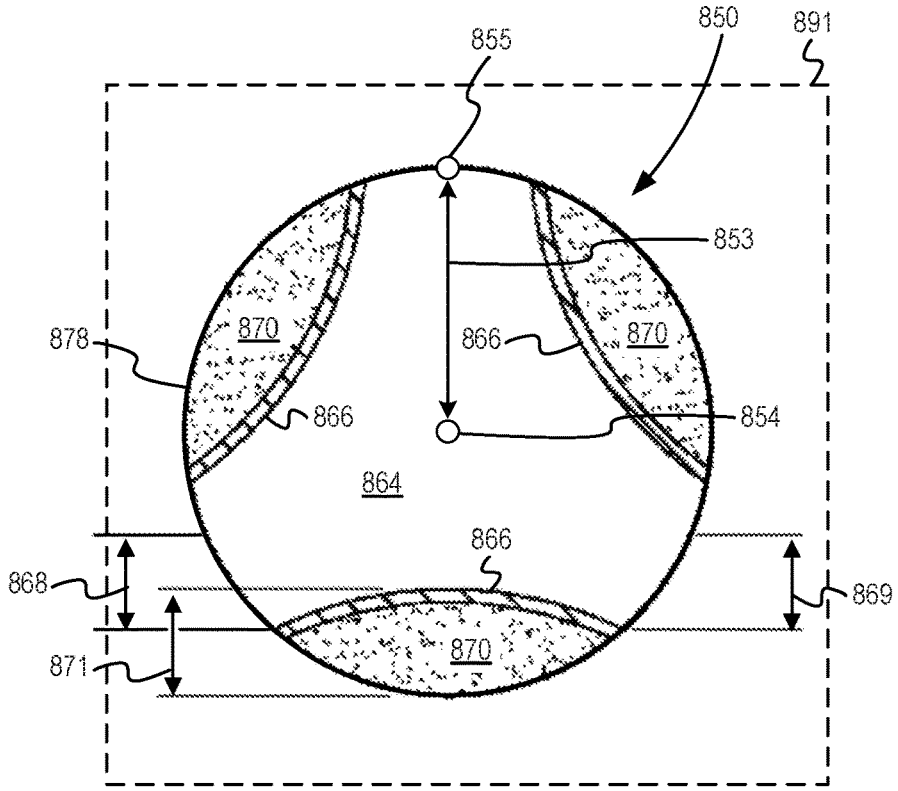

FIG. 8 includes views of a third innermost cutter and a fourth innermost cutter. FIG. 8 includes a dashed box 890 and a dashed box 891, wherein the dashed box 890 is a schematic cutting view of a third innermost cutter 800, and wherein the dashed box 891 is a schematic cutting view of a fourth innermost cutter 850. The third innermost cutter 800 includes reliefs 816 having a curved profile that curve inwards with respect to a maximum radius of a cutting surface 814, wherein the maximum radius can be represented as the line 803 between a surface center 804 and the edge point 805 of the cutting surface 814. As shown in FIG. 8, the reliefs 816 of the third innermost cutter 800 can be centered on approximately opposite sides of the cutting surface 814 and can extent into or stop at the substrate 820. The third innermost cutter 800 can also include a combined cutting arc length comprising the first circular portion 818 and the second circular portion 819. In some embodiments, the third innermost cutter 800 includes a circular portion 828 representing a circular portion of the third innermost cutter 800 that comprises the substrate 820 but does not comprise the cutting surface 814.

The fourth innermost cutter 850 depicted in the dashed box 891 includes three reliefs 866, each having a curved profile that curves inwards with respect to a maximum radius of the cutting surface 864, wherein the maximum radius can be represented as the line 853 between a surface center 854 and the edge point 855. As shown in FIG. 8, the three reliefs 866 of the fourth innermost cutter 850 can be spaced radially around the fourth innermost cutter 850. The fourth innermost cutter 850 also includes a combined cutting arc length comprising the first circular portion 868 and the second circular portion 869. A substrate 870 can be below the cutting surface 864. In some embodiments, the fourth innermost cutter 850 includes a circular portion 878 representing a circular portion of the fourth innermost cutter 850 that comprises the substrate 870 but does not comprise the cutting surface 864.

Figure 9:
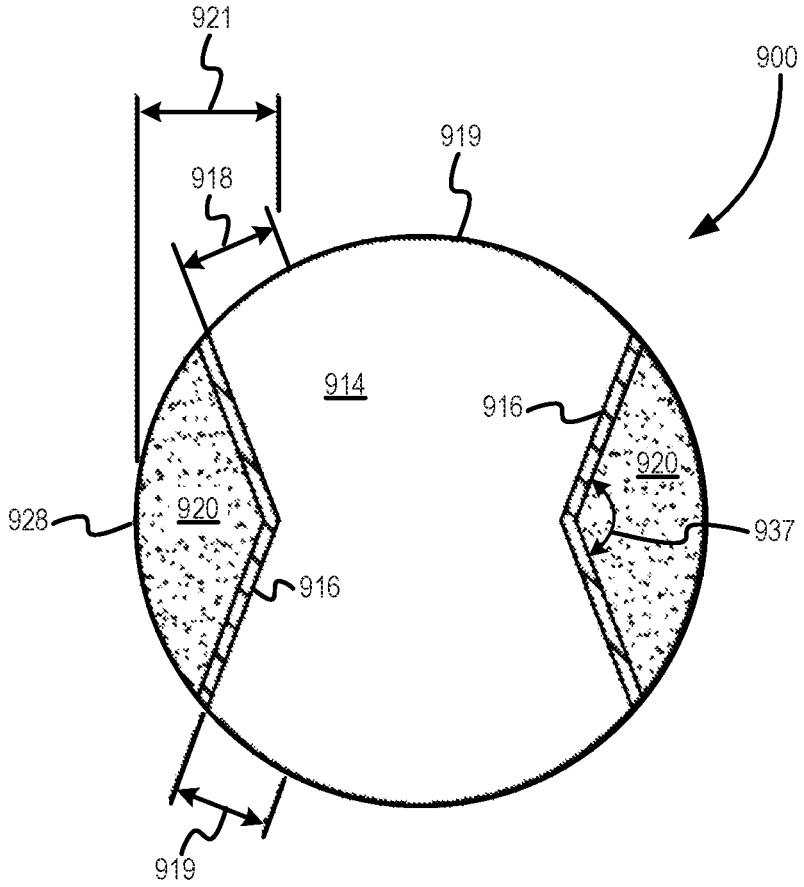
FIG. 9 is a view of a fifth cutter.

FIG. 9 is a view of a fifth cutter. FIG. 9 includes a fifth innermost cutter 900. The fifth innermost cutter 900 includes reliefs 916. The reliefs 916 can be angled and can have two linear portions that meet at an angle 937. In some embodiments, the angle 937 can be between 100 degrees and 170 degrees inclusive. In some embodiments, the angle 937 can be less than 100 degrees or greater than 170 degrees. As shown in FIG. 9, the reliefs 916 of the fifth innermost cutter 900 can be centered on approximately opposite sides of the cutting surface 914. The fifth innermost cutter 900 also includes a combined cutting arc length comprising the first circular portion 918 and the second circular portion 919. A substrate 920 can be below the cutting surface 914. In some embodiments, the fifth innermost cutter 900 includes a circular portion 928 representing a circular portion of the fifth innermost cutter 900 that comprises the substrate 920 but does not comprise the cutting surface 914.

Figure 10:
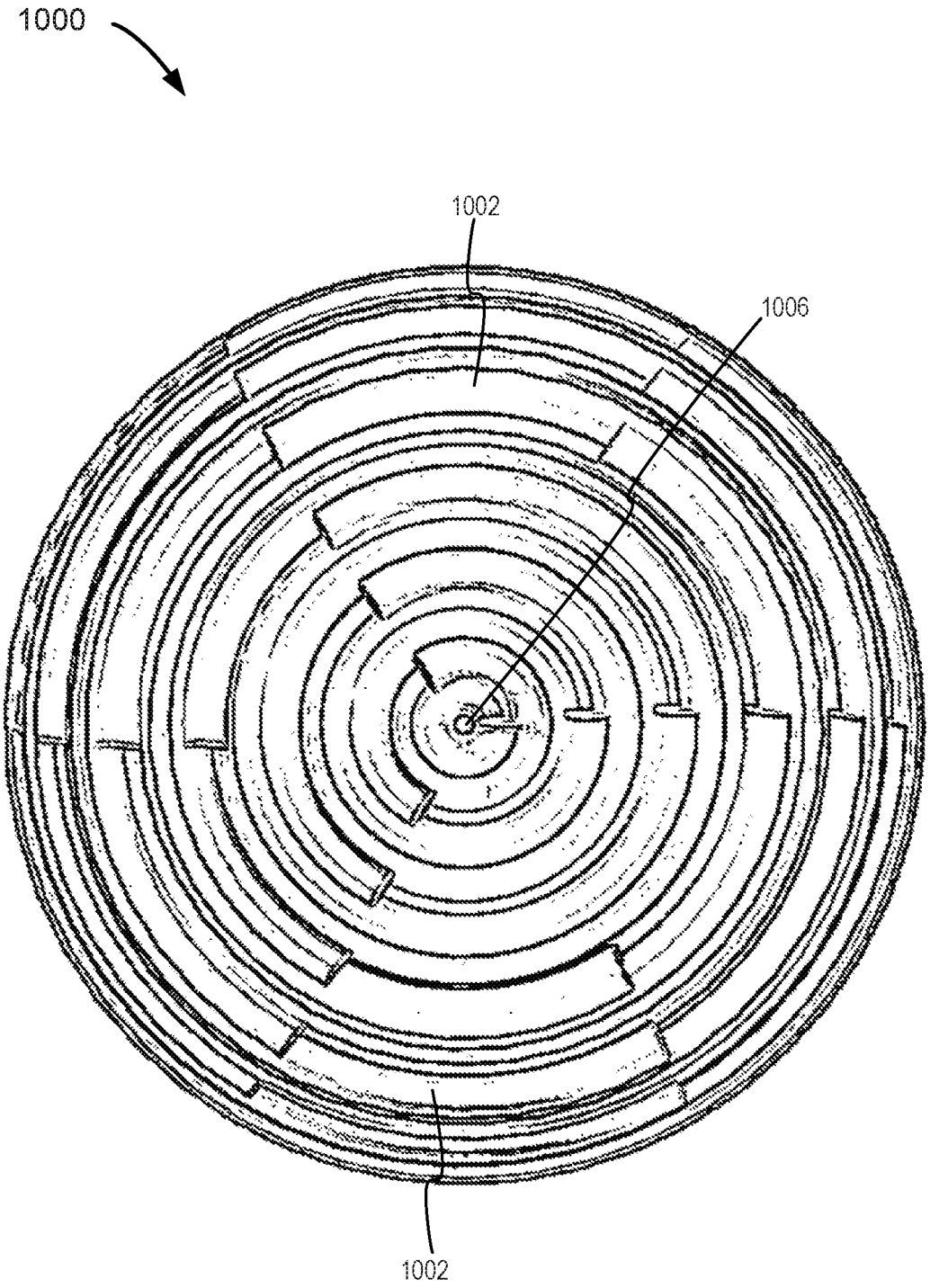
FIG. 10 is a top view of a first example bottom hole pattern formed as a result of the drilling with a drill bit having an innermost cutter.

FIG. 10 is a top view of a first example bottom hole pattern formed as a result of the drilling with a drill bit having an innermost cutter. FIG. 10 depicts a first bottom hole pattern 1000. The first bottom hole pattern 1000 shows spiral tubes 1002 centered around a microcore center 1006. The spiral tubes 1002 can represent cutter paths formed by rotation of a drill bit during a drilling operation. As shown in the first bottom hole pattern 1000, the cutter paths represented by the spiral tubes 1002 avoid the microcore center 1006. With respect to FIG. 2, FIGS. 4A, 4B, and FIGS. 5-9, the drill bit 200 having one or more innermost cutters similar to or the same as the cutters 400, 600, 800, and/or 900 can be used to generate the first bottom hole pattern 1000.

Figure 11:
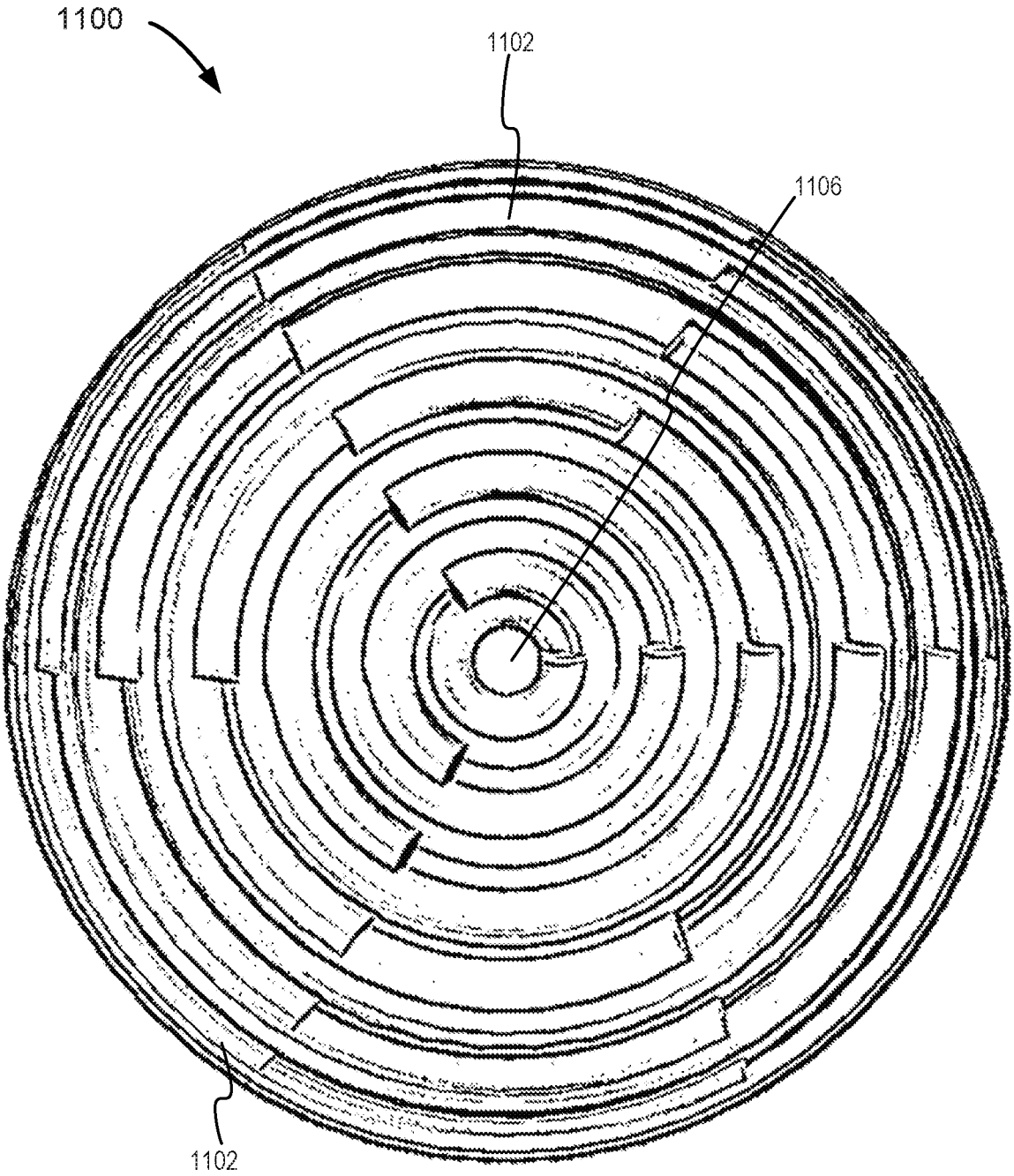
FIG. 11 is a top view of second example bottom hole pattern formed as a result of the drilling with a drill bit having an innermost cutter.

FIG. 11 is a top view of second example bottom hole pattern formed as a result of the drilling with a drill bit having an innermost cutter. FIG. 11 depicts a second bottom hole pattern 1100. The second bottom hole pattern 1100 shows spiral tubes 1102 centered around a microcore center 1106. The spiral tubes 1102 can represent cutter paths formed by rotation of a drill bit during a drilling operation. As shown in the second bottom hole pattern 1100, the cutter paths represented by the spiral tubes 1102 avoid the microcore center 1106. With respect to FIG. 2, FIGS. 4A, 4B, and FIGS. 5-9, the drill bit 200 having one or more innermost cutters similar to or the same as the cutters 400, 600, 800, and/or 900 can be used to form the second bottom hole pattern 1100.

Figure 12:
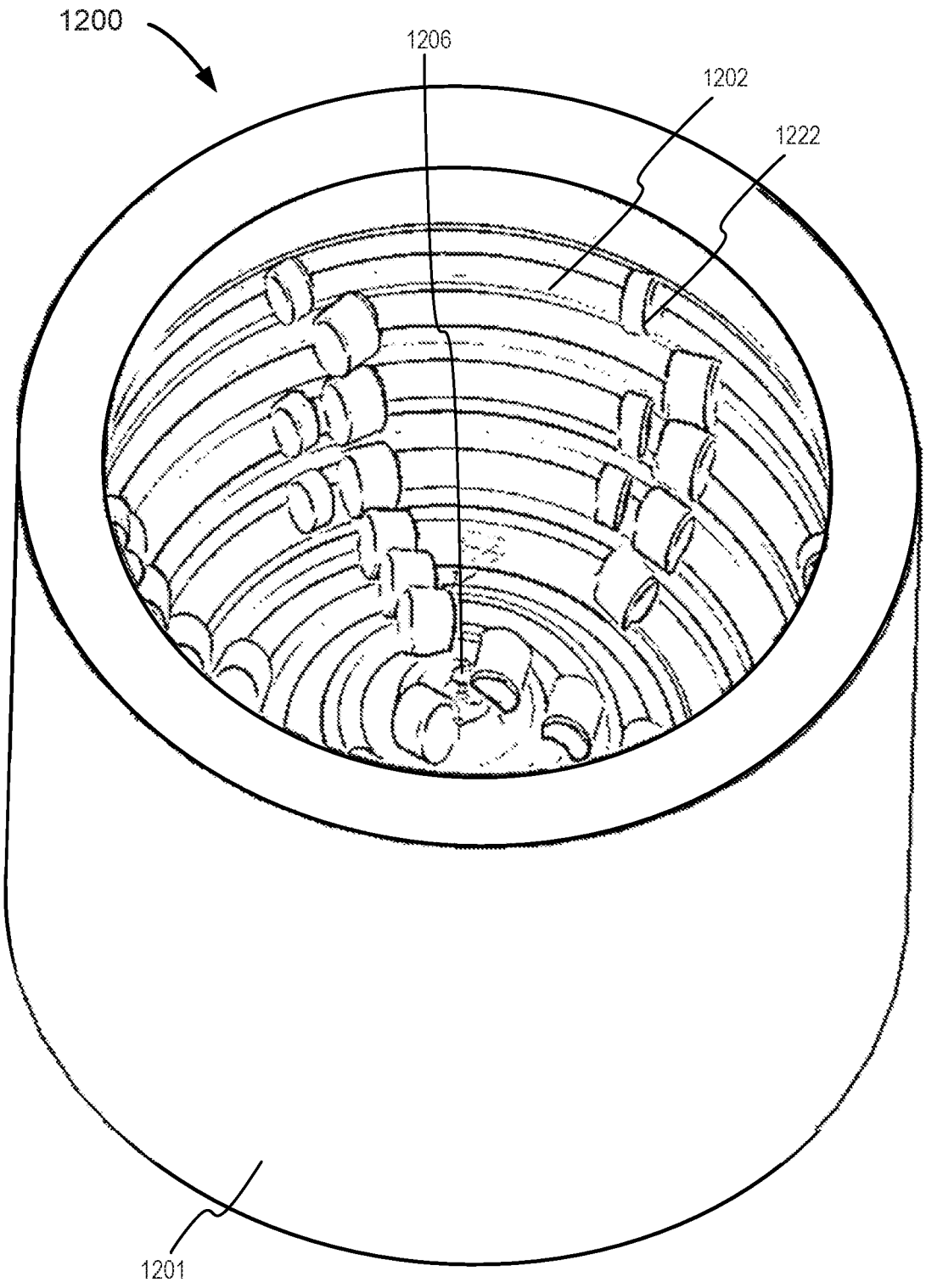
FIG. 12 is an isometric view of a third example bottom hole pattern formed as a result of the drilling with a drill bit having an innermost cutter.

FIG. 12 is an isometric view of a third example bottom hole pattern formed as a result of the drilling with a drill bit having an innermost cutter. FIG. 12 depicts a third bottom hole pattern 1200 surrounded by a portion of a rock formation 1201. The third bottom hole pattern 1200 shows spiral tubes 1202 centered around a microcore center 1206. In addition, the third bottom hole pattern 1200 includes cutter positions represented by the cylinders 1222. The spiral tubes 1202 can represent paths that cutters follow during rotation of a drill bit during drilling operations. As shown in the third bottom hole pattern 1200, the cutter paths represented by the spiral tubes 1202 avoid the microcore center 1206. With respect to FIG. 2, FIGS. 4A, 4B, and FIGS. 5-9, the drill bit 200 having one or more innermost cutters similar to or the same as the cutters 400, 600, 800, and/or 900 can be used to form the third bottom hole pattern 1200.

Figure 13:
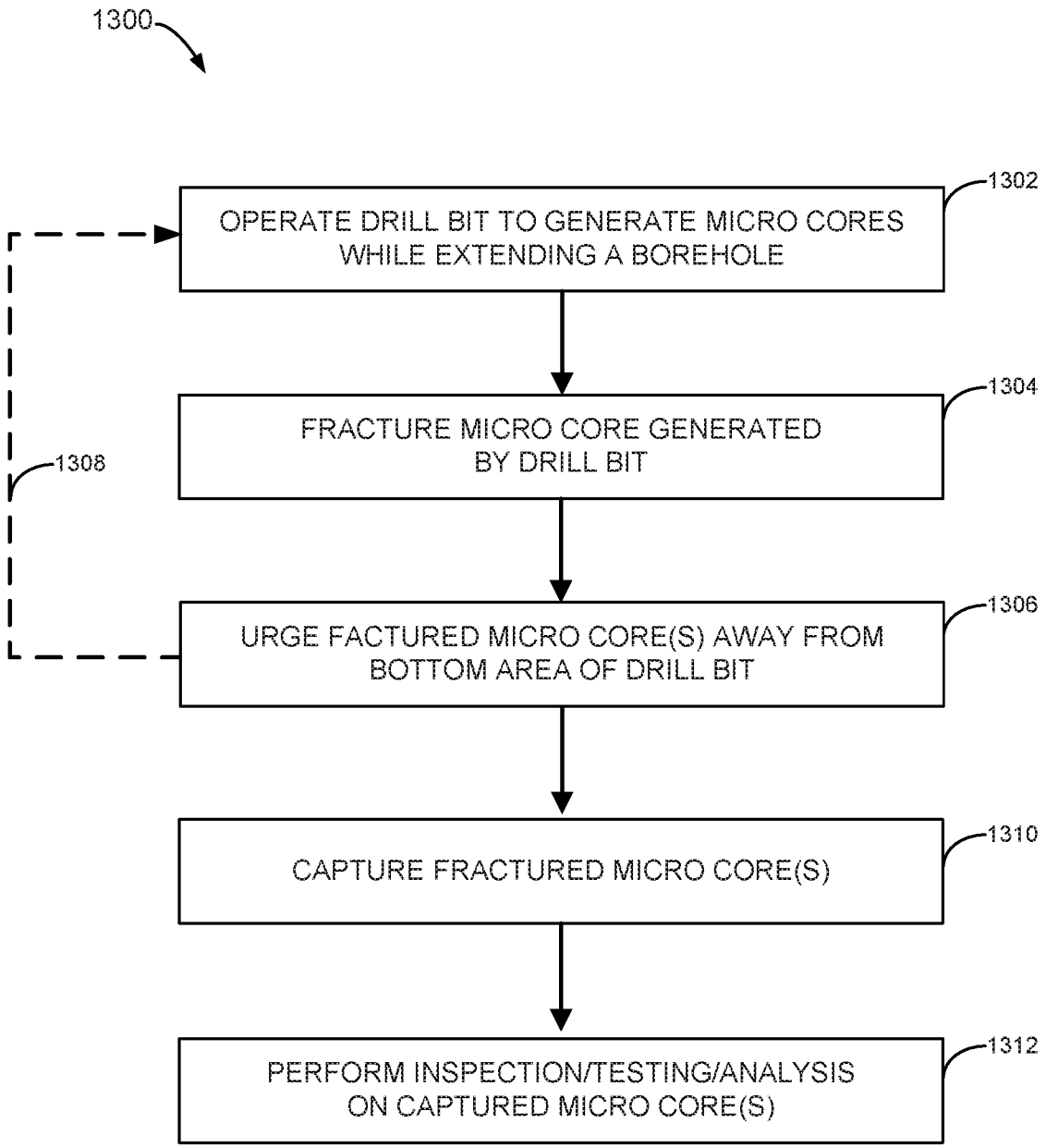
FIG. 13 is a flowchart of a method according to one or more embodiments to the disclosure.

FIG. 13 includes a flowchart 1300 illustrating a method according to various embodiments of the disclosure. Embodiments of the method include operating a drill bit configured to generate micro cores while extending a borehole into a formation material (block 1302). The drill bit may include any of the embodiments of a drill bit configured to generate a micro core as described throughout this disclosure, and any equivalents thereof. For example, embodiments of the drill bit may include inner most cutters that include one or more reliefs configured according to any of the embodiments of reliefs as described throughout the disclosure, and/or any equivalents thereof. For example, the innermost cutter may include a relief on the cutting material of the cutting surface, wherein at least one end of the relief is located at and interrupts a cutting arc. The relief can be formed in various indented shapes, such as a linear indentation, a curved groove, etc. The relief can include various specific shapes. For example, the relief can include a first curved edge, followed by a straight edge, followed by a second curved edge, wherein a curved edge can be any edge wherein two sides of the cutting surface material are at an angle less than zero. In some embodiments, the first curved edge and the second curved edge can cooperate to increase the edge toughness of the cutting surface. In some embodiments, drilling using a straight edge of the relief results in the generation of a micro core using the drill bit. The second curved edge can operate to fracture the micro core under the side load of the drill bit. Additionally, in some embodiments, the cutting arc of engagement between an innermost cutter of the drill bit and a formation can be longer than any other cutters on the drill bit.

Embodiment of the method may include fracturing a micro core generated by the drilling operation from the formation material (block 1304). Fracturing the micro core in various embodiments includes fracturing the micro core as a result of side load force(s) exerted on the micro core by one more inner cutters included on the drill bit performing the drilling operation that is generating the micro cores. Fracturing the micro core in various embodiments includes fracturing the micro cores as a result of a force exerted by a central drill bit surface (e.g., central drill bit surface 170, FIG. 1B) on the micro core. In various embodiments, fracturing of the micro core may including fracturing the micro core as a result of a combination of side load force(s) exerted on the micro core by one more inner most cutters included on the drill bit and force(s) exerted on the micro core as a result of direct contact between the micro core and a central drill bit surface of the drill bit.

Embodiments of the one or more methods may include urging a fractured micro core away from a bottom portion or area of the drill bit performing the drilling operation. Urging of the micro core away from a bottom portion or area of the drill bit may include urging the fractured micro core along an escapeway formed between one or more blades of the drill bit. Urging the micro core away from the bottom portion or area of the drill bit may include using a flow of a fluid, such as a drilling fluid, to urge the fractured micro core away from the bottom portion or area of the drill bit. Urging the micro core away from the bottom portion or area of the drill bit in various embodiments includes conveying, for example using a fluid, the fractured micro core to a top surface and out of the borehole thru an annulus area between a drill string coupled to the drill bit and a borehole wall of the borehole. In various embodiments, the process of generating a micro core by operating the drill bit in a drilling operation, fracturing the micro core, and urging the micro core away from the bottom portion or area of the drill bit may be repeated for any number of cycles as the drilling operation is being performed, as represented by the arrow 1308 coupling block 1306 back to block 1302.

Embodiments of the method may include capturing the fractured micro core (block 1310) and performing an inspection, testing, or other forms of analysis on the captured micro core (block 1312). Capturing the fracture micro core may include catching the micro core in a screening device configured to allow a fluid, such as drilling fluid, to pass through the screening device but to block and capture the micro core(s) being transported by the fluid. Inspection, testing, and/or other types of analysis of the captured micro core(s) may include any type of testing, including visual inspections by an operator such as an engineer or technician, and/or other types of testing, such as chemical analysis, X-ray analysis, imaging of the micro core using any type of imaging equipment, or any other form(s) of analysis that may be used to determine one or more physical properties present in the micro core.

Throughout the application, plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

As used herein, the term "or" is inclusive unless otherwise explicitly noted. Thus, the phrase "at least one of A, B, or C" is satisfied by any element from the set {A, B, C} or any combination thereof, including multiples of any element. A set of items can have only one item or more than one item. For example, a set of numbers can be used to describe a single number or multiple numbers.

Example embodiments of the drill bit and the methods for using a drill bit as described herein may include the following.

Embodiments of the disclosure can include an drill bit comprising a bit body defining a bit rotational axis, a blade attached to the bit body, and a cutter comprising a cutting arc on a cutting surface of the cutter, wherein the cutter comprises at least one relief comprising a straight edge and a curved edge having an end that interrupts the cutting arc. In some embodiments, the cutter is an innermost cutter, wherein the innermost cutter is closer to the bit rotational axis than a second cutter mounted on the blade. In one or more of the embodiments above, the curved edge is convex with respect to a center of the cutter. In one or more of the embodiments above, the curved edge is a first curved edge, and wherein the at least one relief comprises a second curved edge. In one or more of the embodiments above, the second curved edge is concave with respect to a center of the cutter. In one or more of the embodiments above, a length of the straight edge is proportional to a diameter of the cutter. In one or more of the embodiments above, the first curved edge has a first end positioned at a first end of the at least one relief, wherein the straight edge has a first end adjacent to a second end of the first curved edge, and wherein the second curved edge has a first end adjacent to a second end of the straight edge, wherein a second end of the second curved edge is positioned at a second end of the at least one relief.

Embodiments of the disclosure can include a system comprising a drill string, a fixed-cutter drill bit attached to the drill string, wherein the fixed-cutter drill bit comprises a bit body defining a bit rotational axis, a blade attached to the bit body, and a cutter comprising a cutting arc on a cutting surface of the cutter, wherein the cutter comprises at least one relief comprising a straight edge and a curved edge having an end that interrupts the cutting arc. In one or more of the embodiments above, the curved edge is convex. In one or more of the embodiments above, a length of the straight edge is proportional to a diameter of the cutter. In one or more of the embodiments above, the curved edge is a first curved edge, and wherein the at least one relief comprises a second curved edge. In one or more of the embodiments above, the first curved edge has a first end positioned at a first end of the at least one relief, wherein the straight edge has a first end adjacent to a second end of the first curved edge, and wherein the second curved edge has a first end adjacent to a second end of the straight edge, wherein a second end of the second curved edge is positioned at a second end of the at least one relief. In one or more of the embodiments above, the second curved edge is concave.

Embodiments of the disclosure may include a method comprising: operating a drill bit to generate one or more micro cores as part of a drilling process used to extend a borehole into a foundation material, wherein the drill bit comprises a bit body defining a bit rotational axis, a blade attached to the bit body, and a cutter comprising a cutting arc on a cutting surface of the cutter, wherein the cutter comprises at least one relief comprising a straight edge and a curved edge having an end that interrupts the cutting arc. Embodiments of the method may further comprise fracturing each of the one or more micro cores by applying a side load pressure generated by the cutter arc and applied to a side portion of each of the one or more micro cores as each micro core is generated by operating the drill bit; and after fracturing a given micro core of the one or more micro cores, urging the given micro core away from a terminus area of the drill bit. Embodiments of the method may further comprise capturing the fractured micro core and performing testing or other types of analysis on the captured micro core.

Embodiments of the invention can include a cutter and use of a cutter to form micro core in foundation rock, comprising a cutting surface, a cutting arc, and at least one relief having an end that interrupts the cutting arc, wherein the at least one relief comprises a straight edge and a curved edge having an end that interrupts the cutting arc. In one or more of the embodiments above, a length of the straight edge is proportional to a diameter of the cutter. In one or more of the embodiments above, the at least one relief is a first relief, and wherein the cutter comprises a second relief and a third relief, wherein each of the second relief and the third relief comprise a respective curved edge and a respective straight edge. In one or more of the embodiments above, the curved edge is a first curved edge, and wherein the cutter comprises a second curved edge. In one or more of the embodiments above, the second curved edge is concave. In one or more of the embodiments above, the first curved edge has a first end positioned at a first end of the at least one relief, wherein the straight edge has a first end adjacent to a second end of the first curved edge, and wherein the second curved edge has a first end adjacent to a second end of the straight edge, wherein a second end of the second curved edge is positioned at a second end of the at least one relief. In one or more of the embodiments above, the first curved edge is convex and the second curved edge is concave.

What is claimed is:

1. A drill bit comprising:

a bit body defining a bit rotational axis;

a blade attached to the bit body; and a cutter comprising a cutting arc on a cutting surface of the cutter, wherein the cutter comprises at least one relief comprising a first curved edge deviating from an outer edge of the cutter;

a straight edge coupled with the first curved edge, the straight edge configured to generate one or more micro cores, a second curved edge coupled with the straight edge and having an end that interrupts the cutting arc, the second curved edge configured to fracture the one or more micro cores via side load forces of the drill bit exerted on the one or more micro cores; and a third curved edge curving into the outer edge of the cutter and coupled to the second curved edge.

2. The drill bit of claim 1, wherein the cutter is an innermost cutter, and wherein the innermost cutter is closer to the bit rotational axis than a second cutter mounted on the blade.

3. The drill bit of claim 1, wherein the first curved edge and the third curved edge are convex with respect to a center of the cutter.

4. The drill bit of claim 1, wherein the second curved edge is concave with respect to a center of the cutter.

5. The drill bit of claim 1, wherein a length of the straight edge is proportional to a diameter of the cutter.

6. The drill bit of claim 1, wherein the first curved edge has a first end positioned at a first end of the at least one relief, wherein the straight edge has a first end adjacent to a second end of the first curved edge, and wherein the second curved edge has a first end adjacent to a second end of the straight edge, wherein a second end of the second curved edge is positioned at a second end of the at least one relief.

7. A method comprising:

generating, via operation of a drill bit, one or more micro cores as part of a drilling process used to extend a borehole into a foundation material, wherein the drill bit comprises a bit body defining a bit rotational axis, a blade attached to the bit body, and a cutter comprising a cutting arc on a cutting surface of the cutter, wherein the cutter comprises at least one relief comprising a first curved edge deviating from an outer edge of the cutter, a straight edge coupled with the first curved edge, the straight edge configured to generate the one or more micro cores, a second curved edge coupled with the straight edge and having an end that interrupts the cutting arc, the second curved edge configured to fracture the one or more micro cores via side load forces of the drill bit exerted on the one or more micro cores, and a third curved edge curving into the outer edge of the cutter and coupled to the second curved edge.

8. The method of claim 7, further comprising:

fracturing each of the one or more micro cores by applying a side load force generated by the cutting arc and applied to a side portion of each of the one or more micro cores as each micro core is generated by operating the drill bit; and after fracturing a given micro core of the one or more micro cores, urging the given micro core away from a bottom area of the drill bit.

9. The method of claim 7, wherein the first curved edge and the third curved edge are convex.

10. The method of claim 7, wherein a length of the straight edge is proportional to a diameter of the cutter.

11. The method of claim 10, wherein the first curved edge has a first end positioned at a first end of the at least one relief, wherein the straight edge has a first end adjacent to a second end of the first curved edge, and wherein the second curved edge has a first end adjacent to a second end of the straight edge, wherein a second end of the second curved edge is positioned at a second end of the at least one relief.

12. The method of claim 10, wherein the second curved edge is concave.

13. A cutter comprising:

a cutting surface;

a cutting arc; and at least one relief having an end that interrupts the cutting arc, wherein the at least one relief comprises a first curved edge deviating from an outer edge of the cutter;

a straight edge coupled with the first curved edge, the straight edge configured to generate one or more micro cores a second curved edge coupled with the straight edge and having an end that interrupts the cutting arc, the second curved edge configured to fracture the one or more micro cores via side load forces of the drill bit exerted on the one or more micro cores; and a third curved edge curving into the outer edge of the cutter and coupled to the second curved edge.

14. The cutter of claim 13, wherein a length of the straight edge is proportional to a diameter of the cutter.

15. The cutter of claim 13, wherein the at least one relief is a first relief, and wherein the cutter comprises a second relief and a third relief, wherein each of the second relief and the third relief comprise a respective first curved edge, a respective straight edge, a respective second curved edge, and a respective third curved edge.

16. The cutter of claim 13, wherein the second curved edge is concave.

17. The cutter of claim 13, wherein the first curved edge has a first end positioned at a first end of the at least one relief, wherein the straight edge has a first end adjacent to a second end of the first curved edge, and wherein the second curved edge has a first end adjacent to a second end of the straight edge, wherein a second end of the second curved edge is positioned at a second end of the at least one relief.

* * * * *